US012465871B1

(12) United States Patent
Dion et al.

(10) Patent No.: US 12,465,871 B1
(45) Date of Patent: Nov. 11, 2025

(54) CONSTRUCTION SET ELEMENTS

(71) Applicant: Mattel-MEGA Holdings (US), LLC, El Segundo, CA (US)

(72) Inventors: Pierre Dion, Montreal (CA); Louis-Philippe Beaulieu, Montreal (CA); Hugo Messier, Montreal (CA)

(73) Assignee: Mattel-MEGA Holdings (US), LLC, El Segundo, CA (US)

( * ) Notice: Subject to any disclaimer, the term of this patent is extended or adjusted under 35 U.S.C. 154(b) by 0 days.

(21) Appl. No.: 19/169,251

(22) Filed: Apr. 3, 2025

(51) Int. Cl.
*A63H 33/04* (2006.01)
*A63H 33/08* (2006.01)

(52) U.S. Cl.
CPC ..... *A63H 33/086* (2013.01)

(58) Field of Classification Search
CPC ..... A63H 33/086
USPC ..... 446/85–128, 69
See application file for complete search history.

(56) References Cited

U.S. PATENT DOCUMENTS 2,487,654 A * 11/1949 Hoffman ..... A63H 33/102 446/121
2,509,669 A * 5/1950 Borst ..... F16B 5/006 403/294
2,649,803 A * 8/1953 Andre ..... A63H 33/062 446/104
2,765,581 A * 10/1956 Adler ..... A63H 33/101 403/231
3,195,266 A * 7/1965 Onanian ..... A63H 33/101 52/603
3,236,004 A * 2/1966 Name not available ..... A63H 33/042 446/128
3,624,954 A * 12/1971 Name not available ..... A63H 33/084 220/23.4
3,640,017 A * 2/1972 Christiansen ..... A63H 33/04 446/128
3,768,846 A * 10/1973 Hensley ..... F16B 5/0607 52/750

(Continued)

FOREIGN PATENT DOCUMENTS

CN 203736862 U 7/2014
ES 286767 A1 11/1985

OTHER PUBLICATIONS

Design U.S. Appl. No. 29/996,878, filed Apr. 3, 2025.
Design U.S. Appl. No. 29/996,879, filed Apr. 3, 2025.
Design U.S. Appl. No. 29/996,880, filed Apr. 3, 2025.

*Primary Examiner* — Eugene L Kim
*Assistant Examiner* — Matthew B Stanczak
(74) *Attorney, Agent, or Firm* — Plumsea Law Group, LLC

(57) ABSTRACT

A construction set assembly comprises a first construction element and a second construction element. The first construction element, which may be made of metal, may have a distal edge and a proximal recess adjacent to the distal edge, and the second construction element, which may be made of plastic, may have a wall and define a nest opening configured to receive the metal construction element. The wall may have an opening defining a cantilever member having a first end joined integral with the plastic construction element and a second end that is opposite to the first end and is unsupported and deflectable relative to an initial position of the cantilever member, with the second end having a hook protrusion protruding toward an interior of the nest opening.

20 Claims, 22 Drawing Sheets

(56) References Cited

U.S. PATENT DOCUMENTS 3,854,223 A * 12/1974 Dingman, II ..... G09B 23/26 446/92
4,182,072 A * 1/1980 Much ..... A63H 33/065 446/124
4,552,541 A 11/1985 Bolli
4,715,832 A 12/1987 Bach
4,883,440 A * 11/1989 Bolli ..... A63H 33/042 446/128
5,094,643 A * 3/1992 Bolli ..... A63H 33/04 403/348
5,106,093 A * 4/1992 Engel ..... A63F 9/12 446/124
5,373,791 A 12/1994 Bach et al.
5,427,558 A * 6/1995 Knudsen ..... A63H 33/042 446/466
5,779,515 A 7/1998 Chung
5,826,394 A * 10/1998 Barton, Jr. ..... A63H 33/062 52/592.1
5,827,106 A * 10/1998 Crepeau ..... A63H 33/425 446/128
6,450,853 B1 * 9/2002 Larws ..... A63H 33/101 446/124
7,322,873 B2 1/2008 Rosen et al.
7,666,054 B2 2/2010 Glickman et al.
8,961,257 B2 2/2015 Connor
9,636,602 B1 * 5/2017 Samo ..... A63H 17/002
9,914,065 B2 3/2018 Almog et al.
11,020,683 B2 * 6/2021 Fang ..... A63H 33/086
2003/0082986 A1 * 5/2003 Wiens ..... A63H 33/062 446/120
2005/0272301 A1 * 12/2005 Bruder ..... A63H 33/106 439/409
2011/0300772 A1 12/2011 Risvig
2016/0220919 A1 * 8/2016 Almog ..... A63H 33/086
2016/0325200 A1 * 11/2016 Lu ..... A63H 33/042
2018/0221782 A1 * 8/2018 Almog ..... A63H 33/086
2019/0232186 A1 * 8/2019 Wong ..... A63H 33/062
2019/0358558 A1 * 11/2019 Barwald ..... A63H 33/088
2020/0206647 A1 * 7/2020 Jenner ..... E04B 2/08
2020/0330894 A1 10/2020 Ashton
2021/0129039 A1 * 5/2021 Movsesian ..... A63H 33/086
2021/0154590 A1 * 5/2021 Ishimatsu ..... A63H 33/086
2021/0343185 A1 * 11/2021 Wang ..... G09B 23/183
2022/0062782 A1 * 3/2022 Barr ..... A63H 33/062
2023/0321557 A1 * 10/2023 Cho ..... A63H 33/22 439/74

* cited by examiner

CONSTRUCTION SET ELEMENTS

BACKGROUND

Field

The present embodiments relate generally to construction sets, and in particular, to construction sets and modular play structures having interlocking construction set elements, such as building blocks and other interlocking elements, which are made of different materials, such as plastic and metal.

Background

Construction sets that include building blocks, figurines, wheels, and other interlocking construction set elements, which can be connected together to create different objects and structures, are popular with children and adults alike, and are well known in the field of toys, games, and hobbies.

Although interlocking construction set elements may come in various sizes and shapes, a typical element is an interlocking stackable construction block that has a rectangular shape, with upwardly projecting pegs on its top surface arranged in a matrix and coupling means on its bottom surface for releasably interlocking the block to the top of another similar construction block having upwardly projecting pegs. Multiple blocks of varying shapes and sizes may be assembled into various toy constructions, such as houses, cars, airplanes, spaceships, and animals.

Though some objects and structures may be assembled from a single type of construction set element, providing a user with additional options and possibilities of play through an assortment of different building blocks and other building elements is highly desirable. One way to expand options is to incorporate elements made of different materials. Historically, many interlocking construction set elements have been made of plastic to provide adequate strength, durability, and susceptibility to manufacture. The properties of plastic may enable tight manufacturing tolerances and strong complementary interference fit connections between plastic construction elements. However, in attempting to incorporate construction elements made of other materials, such as metal, achieving the same tolerances and interference fits as plastic construction elements may be challenging. In particular, joining plastic construction elements with metal construction elements may be especially difficult due to factors such as different manufacturing tolerances, flexibility properties, thermal expansion properties, hardness properties, and wear properties. In addition, at plastic-to-metal connections, the stronger metal components may permanently scrape, deform, or otherwise damage the plastic components, making repeated mating and adequate friction fits difficult to maintain.

SUMMARY

A construction set assembly is described herein, which may provide securely interlocking construction set elements made of different materials, such as metal and plastic.

In one embodiment, a construction set assembly may include a metal construction element having a distal edge and a proximal recess adjacent to the distal edge, and a plastic construction element having a wall and defining a nest opening configured to receive the metal construction element. The wall may have an opening defining a cantilever member. The cantilever member may have a first end joined integral with the plastic construction element and a second end that is opposite to the first end and is unsupported and deflectable relative to an initial position of the cantilever member. The second end may have a hook protrusion protruding toward an interior of the nest opening. To connect the metal construction element to the plastic construction element, at least a portion of the metal construction element may be inserted into the nest opening such that the distal edge of the metal construction element contacts the hook protrusion, deflects the second end of the cantilever member away from the interior of the nest opening, and moves past the hook protrusion to allow the second end of the cantilever member to move back toward the interior of the nest opening to return to the initial position with the hook protrusion disposed in the proximal recess.

In another aspect, when the metal construction element is disposed in the nest opening, the hook protrusion may contact the distal edge to secure the metal construction element to the plastic construction element.

In another aspect, the plastic construction element may include an upper wall and a bottom side. The upper wall may have an upper surface and a lower surface opposite to the upper surface, and a plurality of pegs may protrude from the upper surface. The pegs may have a uniform size and shape and may be positioned in a matrix. The bottom side may define the nest opening and a plurality of openings for receiving pegs of the size, shape, and positioning associated with the pegs. The wall having the opening defining the cantilever member may extend from the upper wall to the bottom side.

In another aspect, the plastic construction element may have sidewalls extending between the upper wall and the bottom side, and the nest opening may be configured to receive the metal construction element such that the metal construction element nests flush with, or within, planes defined by outer surfaces of the upper wall, the bottom side, and the sidewalls.

In another aspect, the wall having the opening defining the cantilever member may be interior to the plastic construction element and may be perpendicular to, and connect, two of the sidewalls.

In another aspect, the wall having the opening defining the cantilever member may have a wall section having a free end adjacent to the opening, and the plastic construction element may further comprise a reinforcing rib attached to the upper wall and the free end of the wall section.

In another aspect, the sidewalls may include a first lateral sidewall, a second lateral sidewall opposite to the first lateral sidewall, a first longitudinal sidewall, and a second longitudinal sidewall opposite to the first longitudinal sidewall. When viewed from a side facing the first longitudinal sidewall, the first longitudinal sidewall may define a first rectangular notch extending from the bottom side to a bottom edge of the first rectangular notch. When viewed from a side facing the second longitudinal sidewall, the second longitudinal sidewall may define a second rectangular notch extending from the bottom side to a bottom edge of the second rectangular notch. The metal construction element may comprise a plate portion having a first longitudinal rail with a first upper surface and a first longitudinal ledge, and a second longitudinal rail with a second upper surface and a second longitudinal ledge. The nest opening may be configured to receive the metal construction element such that the first longitudinal ledge is linearly aligned with the bottom edge of the first rectangular notch, and the second longitudinal ledge is linearly aligned with the bottom edge of the second rectangular notch. The first upper surface of the first longitudinal rail and the second upper surface of the second longitudinal rail may be flush with, or within, the bottom side.

In another aspect, the plastic construction element may further include a brace member on the lower surface of the upper wall extending from the first longitudinal wall to the second longitudinal wall within a longitudinal length of the first and second rectangular notches.

In another aspect, the metal construction element may further include a base portion having a width narrower than a width of the plate portion from the first longitudinal rail to the second longitudinal rail. The width of the base portion may be configured to fit between the first longitudinal wall and the second longitudinal wall such that the base portion rests on the brace member when the metal construction element is disposed in the nest opening of the plastic construction element, with the first longitudinal ledge linearly aligned with, and spaced apart from, the bottom edge of the first rectangular notch, and the second longitudinal ledge is linearly aligned with, and spaced apart from, the bottom edge of the second rectangular notch.

In another aspect, the plastic construction element may define an upper wall opening through the upper wall adjacent to the snap fitting, and the brace member may be disposed adjacent to the upper wall opening.

In another aspect, the upper wall of the plastic construction element may define an upper wall opening, the metal construction element may define an opening, and the upper wall opening may be aligned with the opening of the metal construction element to define a passageway, when the metal construction element is disposed in the nest opening and connected to the plastic construction element.

In another aspect, the metal construction element may define an opening, and the construction set assembly may further include an attachment means attached to the opening of the metal construction element when the metal construction element is disposed in the nest opening and connected to the plastic construction element.

In another aspect, in the initial position, an inner edge of the second end of the cantilever member that is closest to the nest opening may be aligned with an inner edge of the wall that is closest to the nest opening, and the hook protrusion may protrude into the nest opening. When the distal edge deflects the second end of the cantilever member, the inner edge of the second end of the cantilever member may move farther from the nest opening than the inner edge of the wall.

In another aspect, the wall may have a cylindrical curvature, and perimeter faces of the cantilever member may have a curvature conforming to the cylindrical curvature.

In another aspect, wherein the plastic construction element may include a cylindrical body defining a longitudinal axis, and an interior base wall disposed inside the cylindrical body and perpendicular to the longitudinal axis of the cylindrical body. The nest opening may be on a first side of the interior base wall and defined by the interior base wall and the cylindrical body, and a bottom opening may be on a second side of the interior base wall opposite to the first side of the interior base wall and defined by the interior base wall and the cylindrical body. The wall that has the opening defining the cantilever member may be a wall of the cylindrical body on the first side of the interior base wall. The interior base wall may define an opening adjacent to the wall. The first end of the cantilever member may be disposed adjacent to the opening of the interior base wall.

In another aspect, the metal construction element may comprise a cylindrical disc, the proximal recess may be an annular groove around the cylindrical disc, and the distal edge may be an annular ring around the cylindrical disc.

In another aspect, the plastic construction element may further include a buttress portion disposed at a corner between the cylindrical body and the second side of the interior base wall, adjacent to the opening of the interior base wall.

In another aspect, the metal construction element may be made of a zinc alloy and the plastic construction element may be made of acrylonitrile butadiene styrene.

In another embodiment, a construction set element of a construction set assembly may comprise an upper wall, a bottom side that is opposite to the upper wall, a wall that extends perpendicularly from the upper wall to the bottom side, and a plurality of sidewalls extending between the upper wall and the bottom side. The upper wall may have an upper surface and a lower surface opposite to the upper surface. A plurality of pegs may protrude from the upper surface. The pegs may have a uniform size and shape and may be positioned in a matrix. The bottom side may define a nest opening and a plurality of openings for receiving pegs of the size, shape, and positioning associated with the pegs. The wall that extends perpendicularly from the upper wall to the bottom side may have an opening defining a cantilever member. The cantilever member may have a first end joined integral with the construction set element and a second end that is opposite to the first end and is unsupported and deflectable relative to an initial position of the cantilever member. The second end may have a hook protrusion protruding toward an interior of the nest opening. The nest opening may be configured to receive into the nest opening a second construction set element having a distal edge and a proximal recess adjacent to the distal edge, such that the second construction set element nests flush with, or within, planes defined by outer surfaces of the upper wall, the bottom side, and the plurality of sidewalls, with the hook protrusion disposed in the proximal recess.

In another embodiment, a construction set element of a construction set assembly may comprise a cylindrical body defining a longitudinal axis, and an interior base wall disposed inside the cylindrical body and perpendicular to the longitudinal axis of the cylindrical body. A nest opening may be defined by the interior base wall and the cylindrical body on a first side of the interior base wall, and a bottom opening may be defined by the interior base wall and the cylindrical body on a second side of the interior base wall opposite to the first side of the interior base wall. A wall of the cylindrical body on a first side of the interior base wall may have an opening defining a cantilever member. The cantilever member may have a first end joined integral with the construction set element and a second end that is opposite to the first end and is unsupported and deflectable relative to an initial position of the cantilever member. The second end may have a hook protrusion protruding toward an interior of the nest opening. The interior base wall may define an opening adjacent to the wall. The first end of the cantilever member may be disposed adjacent to the opening of the interior base wall. The nest opening may be configured to receive into the nest opening a second construction element having a distal edge and a proximal recess adjacent to the distal edge, with the hook protrusion disposed in the proximal recess.

Other objects, features, and advantages of the present embodiments will become apparent to those skilled in the art from the following detailed description. It is to be understood, however, that the detailed description and specific examples, while indicating some embodiments, are given by way of illustration and not limitation. Many changes and modifications within the scope of the present embodiments may be made without departing from the spirit thereof, and the present embodiments include all such modifications.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
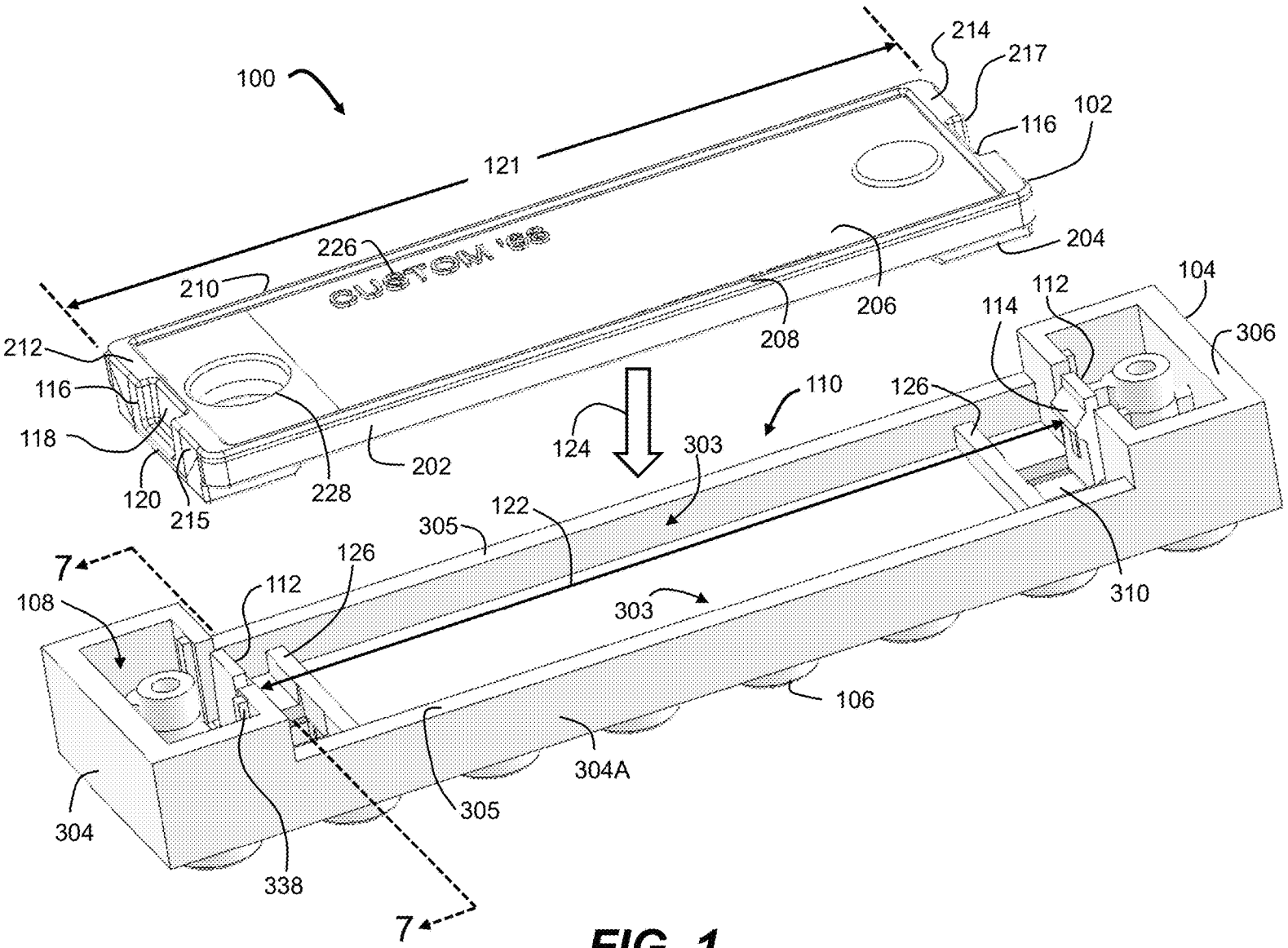
FIG. 1 is a schematic diagram that illustrates a perspective view of a construction set assembly in a disassembled configuration, in accordance with a first embodiment.

Embodiments may provide a construction set assembly with two construction elements that are made of different materials (e.g., metal and plastic) and include provisions for detachably connecting the construction elements while accommodating differences in the material properties of the construction elements to provide a secure connection that minimizes permanent deformation, marring, or other damage to the construction elements. A detachable connection may include a deflectable snap fit member on a plastic construction element that temporarily deflects to allow passage of a distal edge of a metal construction element past a hook protrusion of the snap fit member and that returns to its initial configuration with the hook protrusion disposed in a proximal recess or catch of the metal construction element. The metal construction element may be held securely to the plastic construction element by the hook protrusion disposed within the recess. In an embodiment, the two construction elements may be a plastic block-like construction element and a metal plate. In another embodiment, the two construction elements may be a plastic cylindrical construction element, such as a wheel, and a metal cylindrical construction element, such as a wheel hub cap.

For purposes of convenience, various directional adjectives are used in describing the embodiments. For example, the description may refer to the top, bottom, and side portions or surfaces of a component. It may be appreciated that these are only intended to be relative terms, and, for example, the top and bottom portions may not always be aligned with vertical up and down directions depending on the orientation of a component or construction.

FIGS. 1-8 illustrate a first embodiment of a construction set assembly. FIGS. 9-22 illustrate a second embodiment of a construction set assembly.

In general, toy construction blocks are well known in the art and come in various sizes and shapes. The blocks are often rectangular in shape and have upwardly projecting pegs on their top surface arranged in a matrix, and means on their bottom surface for releasably interlocking one of these blocks on top of another toy construction block or other element. Many other shapes are possible. Using a plurality of these blocks, one may assemble various structures, such as houses, cars, and airplanes. These blocks are extremely versatile given the variety of shapes available and their convenient interlocking mechanism. Exemplary construction blocks that may be used in a construction set are MEGA construction blocks produced by Mattel, Inc. of El Segundo, California. Other examples of toy construction blocks that could be used in a construction set are disclosed in U.S. Pat. No. 5,827,106, issued Oct. 27, 1998, and U.S. Pat. No. 5,779,515, issued Jul. 14, 1998, both of which are herein incorporated by reference in their entirety.

A block may comprise pegs that are arranged in a particular array or matrix, which may correspond to the approximate geometry of the block. As used herein, the term 'geometry' generally refers to the shape and/or relative arrangement of the parts of something. Each array may be characterized by a number of rows of pegs and the number of pegs within each row (e.g., rows and columns of pegs). As an example, a block may be configured as a 2×4 array, with pegs approximately equally spaced in 2 rows of 4 pegs each. Alternatively, a block could be configured in any other kind of array, including 1×2, 1×3, 1×4, 2×2, 2×3, 2×4, 3×3, 3×4, as well as any other arrays of pegs.

In some embodiments, a block may be provided with a plurality of openings for receiving complementary-shaped construction elements. As with the pegs on top of a block, the opening regions (or simply openings) on the lower side of a block may also be configured in arrays (i.e., a 2×4 array of openings). Examples of blocks with openings for receiving construction toy elements are disclosed in U.S. Pat. No. 7,666,054, issued Feb. 23, 2010, which is herein incorporated by reference in its entirety.

Figure 2:
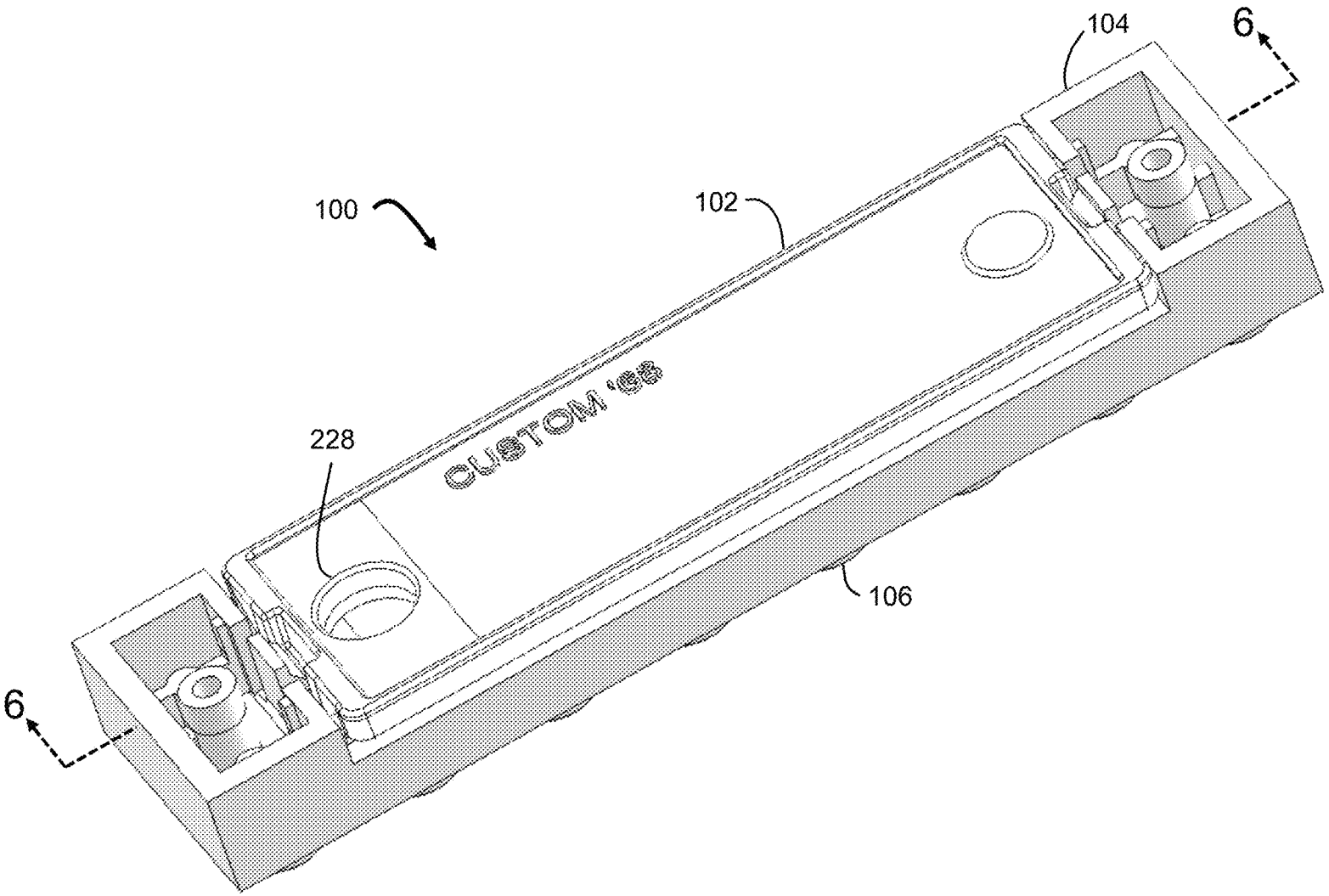
FIG. 2 is a schematic diagram that illustrates a perspective view of the construction set assembly of FIG. 1 in an assembled configuration, according to an embodiment.
Figure 3:
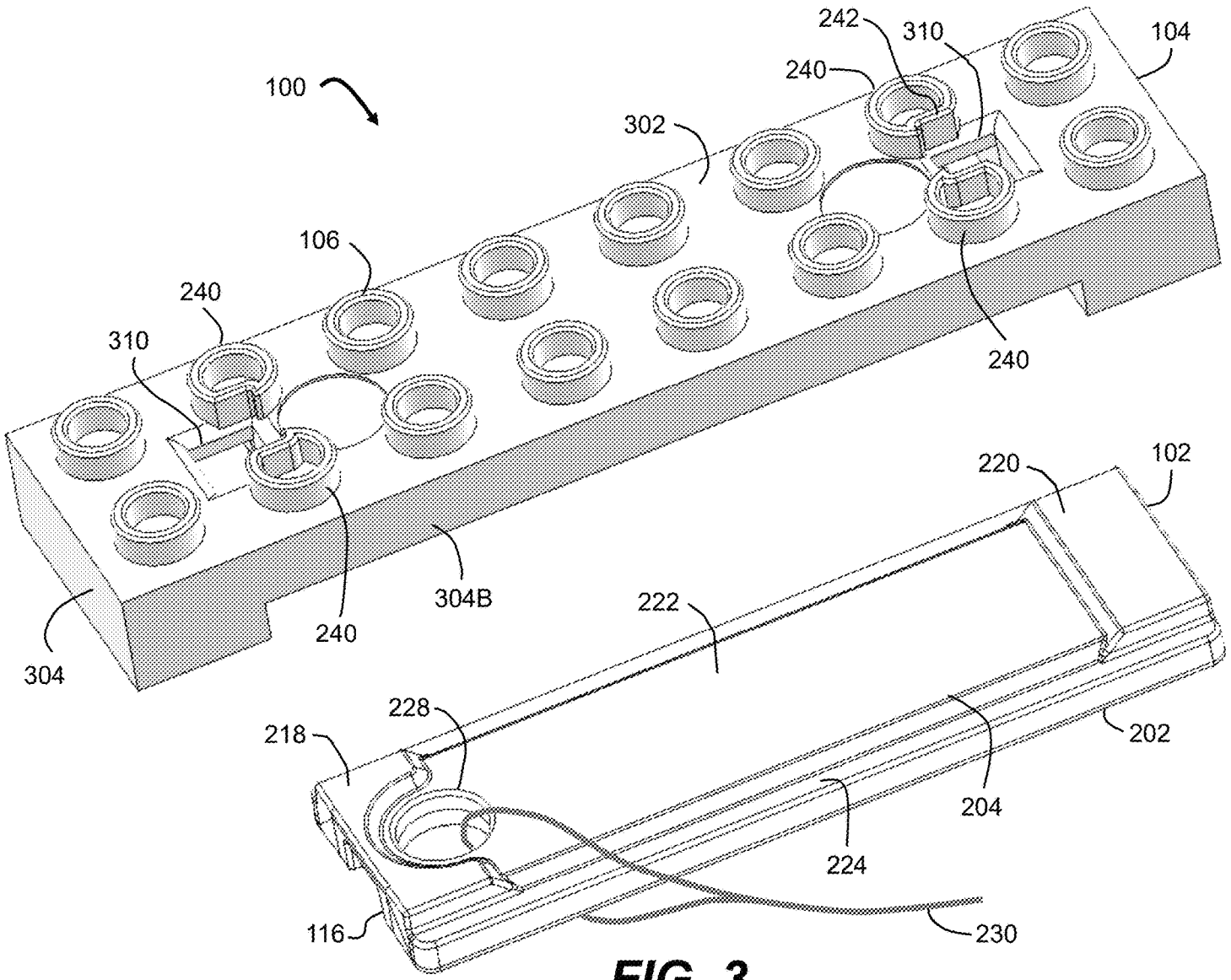
FIG. 3 is a schematic diagram that illustrates another perspective view of the construction set assembly of FIG. 1 in a disassembled configuration, according to an embodiment.
Figure 4:
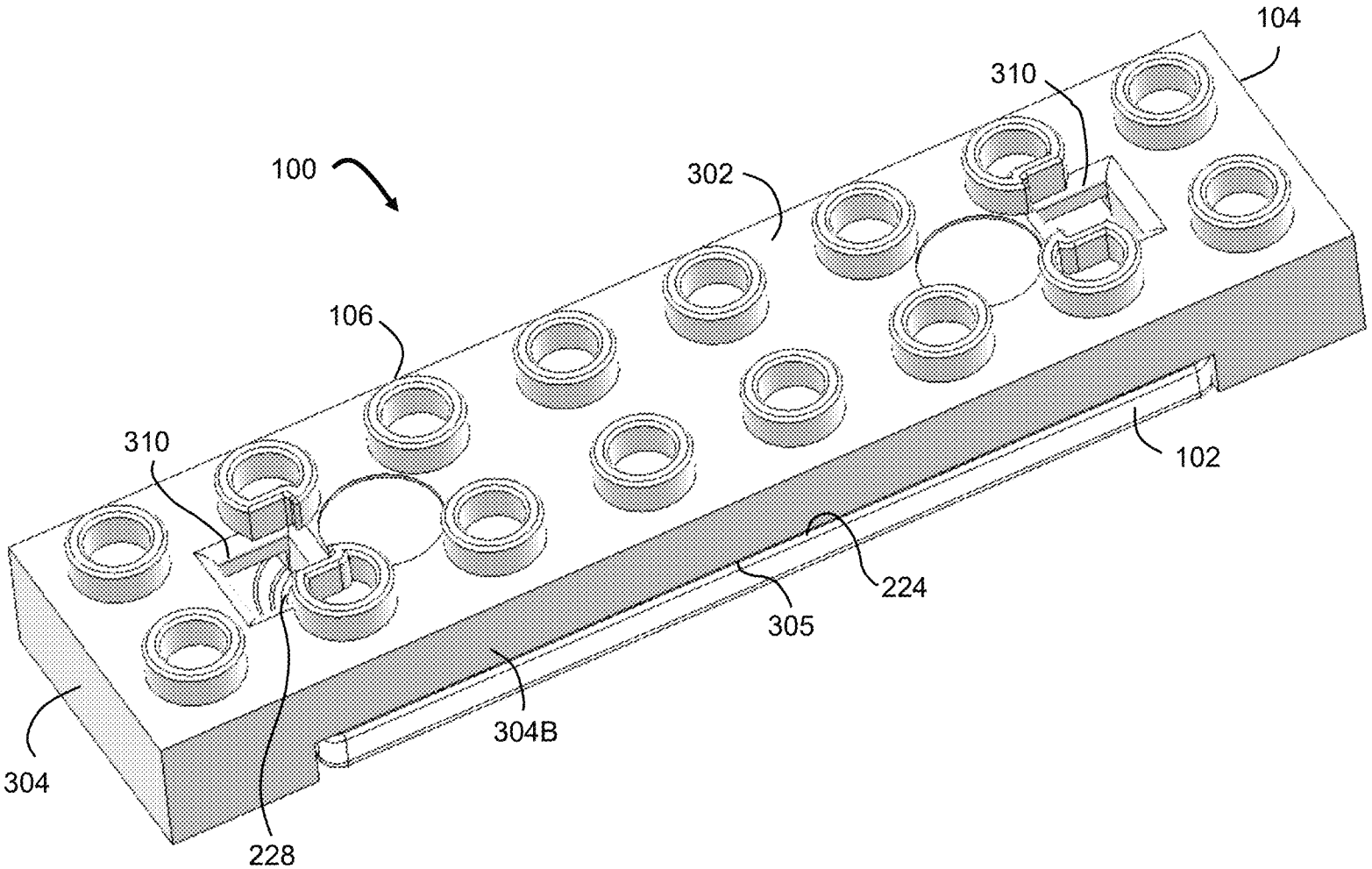
FIG. 4 is a schematic diagram that illustrates another perspective view of the construction set assembly of FIG. 1 in an assembled configuration, according to an embodiment.

FIGS. 1 and 3 are schematic diagrams that depict exploded, or disassembled, perspective views of an embodiment of a construction set assembly 100. FIGS. 2 and 4 are schematic diagrams that depict assembled views of the construction set assembly 100 of FIGS. 1 and 3. Referring to FIGS. 1-4, the construction set assembly 100 may comprise a first construction element 102 and a second construction element 104. Alternatively, a construction set assembly could include additional elements, including other interlocking elements, block-like or otherwise, joined together in a build, such as a build representing an automobile or other vehicle.

First construction element 102 and second construction element 104 may be made of different materials and include provisions for a detachable connection between the elements that minimizes permanent deformation, marring, or other damage to the construction elements. In an embodiment, referring to FIGS. 1-4, relative to each other, first construction element 102 may be made of a stronger, harder, and more durable material, such as metal (e.g., diecast metal, as typically used for toy vehicles), and formed as a plate, and second construction element 104 may be made of a more flexible yet also durable material, such as plastic, and formed as a block having provisions for interlocking with other like blocks, such as protruding pegs 106 and coupling means 108 that are configured to receive pegs (e.g., sized and shaped to receive a peg in a tight friction fit). In embodiments, first construction element 102 may be made of a zinc alloy and second construction element 104 may be made of acrylonitrile butadiene styrene ("ABS").

To provide a detachable connection, second construction element 104 may define a nest opening 110 configured to receive first construction element 102. In embodiments, nest opening 110 may be shaped similarly to first construction element 102 and sized slightly larger than first construction element 102, so that first construction element 102 may fit snugly within nest opening 110 to minimize relative movement between the elements. To further secure the construction elements 102 and 104, while still allowing for convenient disassembly, construction elements 102 and 104 may include one or more detachable fittings, such as interference fittings, press-fit fittings, or snap fittings. For example, as shown in the embodiment of FIGS. 1-4, second construction element 104 may include one or more deflectable cantilever snap fittings 112, each of which connects to a snap fit receiving portion 116 of the first construction element 102. A snap fit receiving portion 116 may include a proximal recess 118 and a distal edge 120. A cantilever snap fitting 112 may have a hook protrusion 114 that protrudes into the interior of the nest opening 110. In embodiments, first construction element 102 has a dimension 121, in this example the length, that is received within the nest opening 110 of second construction element 104 and is greater than a distance 122 between a hook protrusion 114 and another structure of the second construction element 104 defining the nest opening 110, which could be a wall or as in the example of FIG. 1, another opposing hook protrusion of another deflectable cantilever snap fitting 112.

In embodiments, different relative dimensions, such as between distances 121 and 122, may permit the establishment of a detachable connection by temporarily deflecting a snap fitting of a deflecting construction element with a fixed construction element, and then allowing the snap fitting to return to its original position, with a portion of the snap fitting disposed in a receiving portion of the fixed construction element. For example, as represented by arrow 124 in FIG. 1, first construction element 102 may be lowered into nest opening 110 with snap fit receiving portions 116 aligned with cantilever snap fittings 112, such that the distal edges 120 contact the hook protrusions 114 and push the hook protrusions 114 outward, thereby deflecting the free ends of the cantilever snap fittings 112 away from the interior of next opening 110 to allow passage of the first construction element 102 into the nest opening 110. When the distal edges 120 pass beyond the hook protrusions 114 and further into nest opening 110, the free ends of the cantilever snap fittings 112 may move back toward the interior of the nest opening 110 and return toward their original position, at which point the hook protrusions 114 are disposed within the proximal recesses 118 of the snap fit receiving portions 116 of the first construction element 102, as shown in FIG. 1 and in the cross-sectional perspective view of FIG. 6. In embodiments, the thickness of a distal edge 120 and the position of a hook protrusion 114 may be configured such that, when the first construction element 102 is nested within the opening 110, the hook protrusion 114 presses against the distal edge 120 to keep the first construction element 102 securely connected to the second construction element 104.

Figure 7:
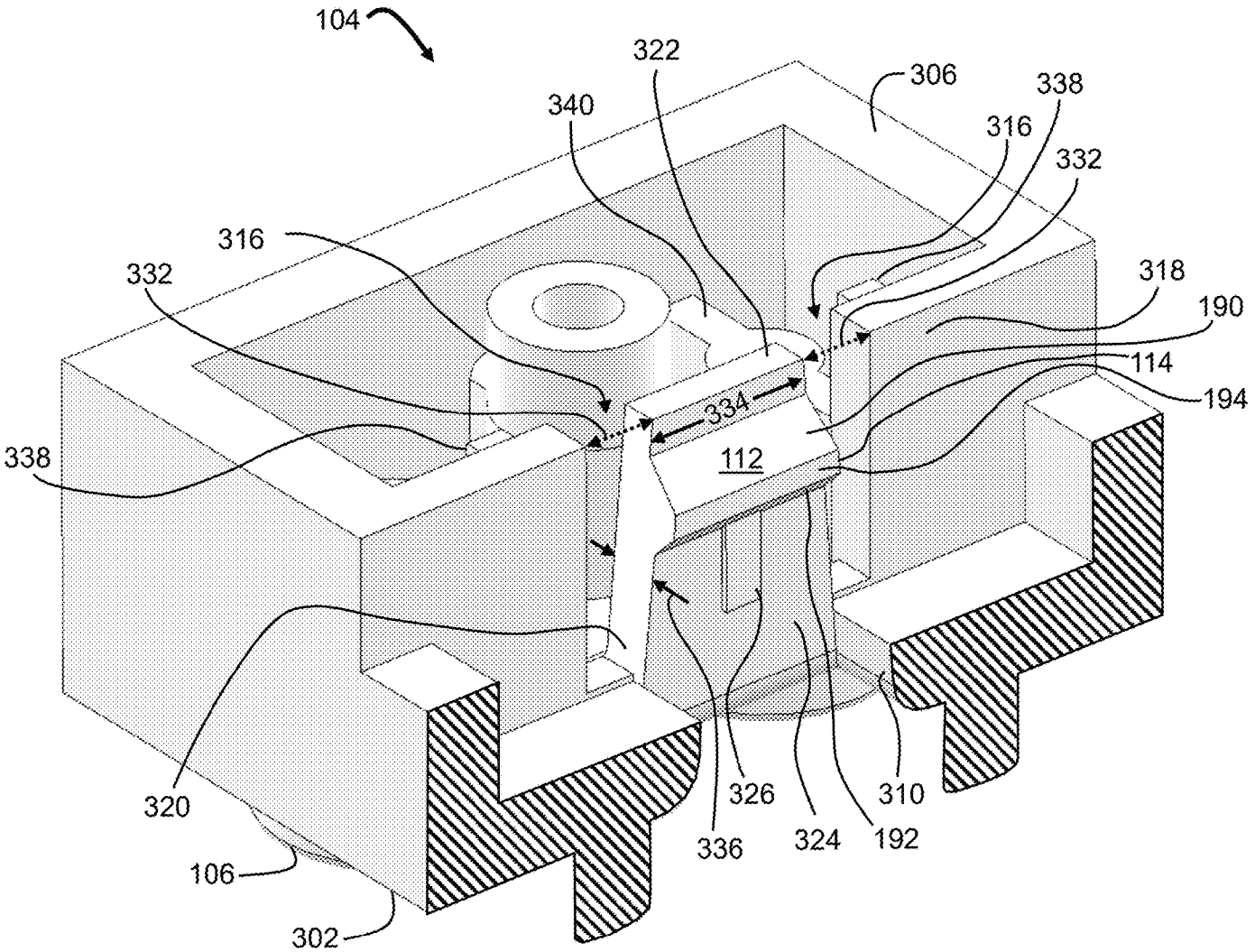
FIG. 7 is a schematic diagram that illustrates a cross-sectional perspective view of the second construction element of the construction set assembly of FIG. 1, taken along line 7-7 of FIG. 1 (laterally with respect to the assembly), according to an embodiment.

FIG. 7 illustrates an enlarged cross-sectional perspective view of one end of second construction element 104 taken along line 7-7 of FIG. 1, according to an embodiment. As shown, cantilever snap fitting 112, also referred to herein as a cantilever member, may be formed by an opening in a wall of second construction element 104, such as opening 316 in an interior wall 318 in this embodiment. Snap fitting 112 may extend from an attached end 320 to a free end 322 that is unsupported and deflectable relative to an initial, non-deflected position. In embodiments, in the non-deflected position, the inside edge of the free end 322 (closest to the nest opening 110) may be in line with the inside edges of the interior walls 318 as represented by the broken line arrows 332. Snap fitting 112 may also increase in width 334 (laterally with respect to second construction element 104, as shown) and thickness 336 (longitudinally with respect to second construction element 104, as shown) from the free end 322 to the attached end 320. The increasing width 334 may allow at the free end 322 greater separation between the snap fitting 112 and the interior wall 318 for more unobstructed movement, while also providing a wider base at the attached end 320 for a stronger, more durable connection to the upper wall 302 of the second construction element 104. The increasing thickness 336 may also provide a stronger, more durable connection to the upper wall 302 of the second construction element 104.

The hook protrusion 114 of snap fitting 112 may protrude toward the interior of the nest opening 110 and may have a first flat face 190 outwardly angled from an interior wall 324 of the snap fitting 112, a second opposing flat face 192 outwardly angled from the interior wall 324, and a third immediate flat face 194 between and connecting the first and second flat faces and facing the interior of the nest opening 110. The interior wall 324 of snap fitting 112 may be aligned with, or continuous with, an inside surface of an opening 310 defined by second construction element 104 through upper wall 302, and may have, below the hook protrusion 114, the increased thickness 336, which features may lead to surprising benefits in increasing the strength and durability of the snap fitting 112 at its base and avoiding potentially weaker stress points, e.g., sharp corners subject to cracking. That configuration may also allow for more convenient injection molding and release of a construction element from a mold. Snap fitting 112 may also include a pad 326 on the interior surface 324 disposed between the hook protrusion 114 and the attached end 320, which may facilitate mold release, as well as serve as a wear pad that the distal edge 120 of the first construction element 102 may contact, to avoid wear and other damage to the snap fitting 112. Although the embodiment of FIG. 7 illustrates a snap fitting 112 having a generally trapezoidal shape, an interior wall 318 having generally rectangular sections, and an opening 310 having a generally rectangular shape, other shapes, sizes, and proportions are possible, including more rounded geometries.

Although embodiments of FIGS. 1-8 include two cantilever snap fittings 112 on second construction element 104, other embodiments may include just one snap fitting or more than two snap fittings. As an example using one snap fitting, referring to FIG. 1, the second construction element 104 could be modified from what is shown, to have a snap fitting 112 on only the left side and an alternative connection means on the right side, such as a fixed hook or overhang under which the right end of the first construction element 102 can be inserted and held. With that modified configuration, the right end of the first construction element 102 may be slid under the alternative connection means and then the left end of the first construction element 102 may be rotated around the fixed right end to lower the left end down to temporarily deflect the snap fitting 112 and engage the snap fitting 112 with the first construction element 102 disposed in the nest opening 110 and connected to the second construction element 104, as described above. As an example using more than two snap fittings 112, referring again to FIG. 1, in addition to the snap fittings 112 on the left and right sides of the second construction element 104, one or more snap fittings may be added to each of the opposing longitudinal walls, for example, a snap fitting could be added at approximately a midpoint 303 of each of the opposing longitudinal walls.

In incorporating a snap fitting into a construction element intended to securely connect to other construction elements, especially those using projecting pegs and coupling means, embodiments may include provisions for compensating for wall openings needed to form, and allow free movement of, a snap fitting. For example, referring to FIG. 7, opening 316 around snap fitting 112 may create two shorter sections of interior wall 318 that may provide less structural rigidity than if the interior wall 318 were continuous laterally across second construction element 104, especially at the free corners of the sections adjacent to the opening 316. Accordingly, embodiments may provide reinforcing members that strengthen sections of an interior wall around the openings between which a snap fitting is disposed. For example, as shown in FIGS. 1 and 7, reinforcing ribs 338 may be attached to the interior wall 318 on a side opposite to the nest opening 110 and disposed near the free corners of the interior wall 318, to increase the strength and rigidity of the sections of the interior wall 318. A reinforcing rib 338 may extend from the upper wall 302 to just below the bottom side 306, and may include an additional section 340 extending away from the base of the interior wall 318 longitudinally with respect to the second construction element 104. In addition to providing reinforcement, reinforcing ribs 338 may also provide another surface by which to frictionally couple with a projecting peg of another construction element.

In addition to providing a secure connection between the first construction element 102 and the second construction element 104, embodiments may include provisions for incorporating two detachably connected construction elements, made of different materials, into a large build of interlocking stackable construction set elements having a matrix arrangement of projecting pegs and coupling means. Referring to FIGS. 1-4, second construction element 104 may have a block-like shape with an upper wall 302 from which a plurality of pegs 106 project, four sidewalls 304, and a bottom side 306 defining one or more coupling means 108 and a nest opening 110. In embodiments, to facilitate the incorporation into a matrix arrangement along with other construction set elements, the nest opening 110 defined by the second construction element 104 may be configured to allow the first construction element 102 to nest flush with, or within, planes defined by the outer surfaces of the upper wall 302, the bottom side 306, and the four sidewalls 304. For example, the nest opening 110 may be configured to allow first construction element 102 to nest flush with, or within, the outer surface of the bottom side 306 and the two opposing side surfaces 304A and 304B, as shown in the assembled views of FIGS. 2, 4, and 5. This type of configuration may allow a plate and block combination to conform to a three-dimensional matrix of projecting pegs and coupling means of an interlocking construction set and uniformly and seamlessly connect to other interlocking construction set elements of a build.

In embodiments, the second construction element 104 may include provisions for securely supporting the first construction element 102 within the nest opening 110 and for providing additional structural integrity to the second construction element 104 to compensate for the typical portions of a construction element that are omitted to create the nest opening 110. For example, referring to FIG. 1, portions of the opposing longer sidewalls 304 are omitted to create, when viewed from the side facing a longer sidewall 304, a rectangular notch in which the first construction element 102 nests. Those omitted portions may reduce the structural integrity of the second construction element 104, for example, in terms of rigidity, flexure, and durability, especially when compared to a typical cuboid building block having four complete rectangular sidewalls. Accordingly, embodiments may provide brace members 126 as shown in FIG. 1, for example. Brace members 126 may extend laterally between, and connect to, opposing sidewalls 304 to provide additional lateral structural support to second construction element 104, for example, increasing resistance to bending, twisting, or other undesired relative movement of portions of second construction element 104. Although the embodiment of FIG. 1 depicts two brace members 126, the number of brace members may vary depending on the desired additional structural support. In addition, the size, shape, and placement of the brace members 126 may vary depending on the desired additional structural support.

Brace members may also be configured to compensate for reduced structural integrity caused by openings through a construction element, such as decorative openings, access openings, or openings needed for injection molding purposes. For example, as shown in FIGS. 1 and 3, second construction element 104 may define openings 310 through upper wall 302, and at each opening 310 a brace member 126 may extend between the opposing sidewalls 304 and may be positioned adjacent to the opening 310. In embodiments, a surface of a brace member 126 may be aligned with, or continuous with, a surface defining an opening 310. For example, as shown in the cross-sectional perspective view of FIG. 6, an opening 310 may be rectangular, a brace member 126 may be a rectangular cuboid, and a face of the brace member 126 may be aligned with, or continuous with, an inside face of the opening 310, as shown at arrow 312. Brace members 126 may therefore reinforce the upper wall 302 in the area around the openings 310, while also reinforcing the opposing sidewalls 304. Although in this example the openings 310 and brace members 126 are rectangular, other shapes and configurations that have aligned or continuous walls are possible.

Brace members 126 may also be configured to support the first construction element 102 within the nest opening 110. As shown in the cross-sectional perspective view of FIG. 6, the ends of first construction element 102 may rest on brace members 126 to further support element 102, in addition to support provided by the opposing sidewalls 304 on which the longitudinal sides of first construction element 102 may rest. This configuration of the brace members 126 and opposing sidewalls 304 may also allow for a void 314 between the first construction element 102 and the upper wall 302 of the second construction element 104 to reduce the amount of material needed to form second construction element 104, thereby reducing manufacturing costs and reducing the weight of the second construction element 104 and construction set assembly 100.

Figure 6:
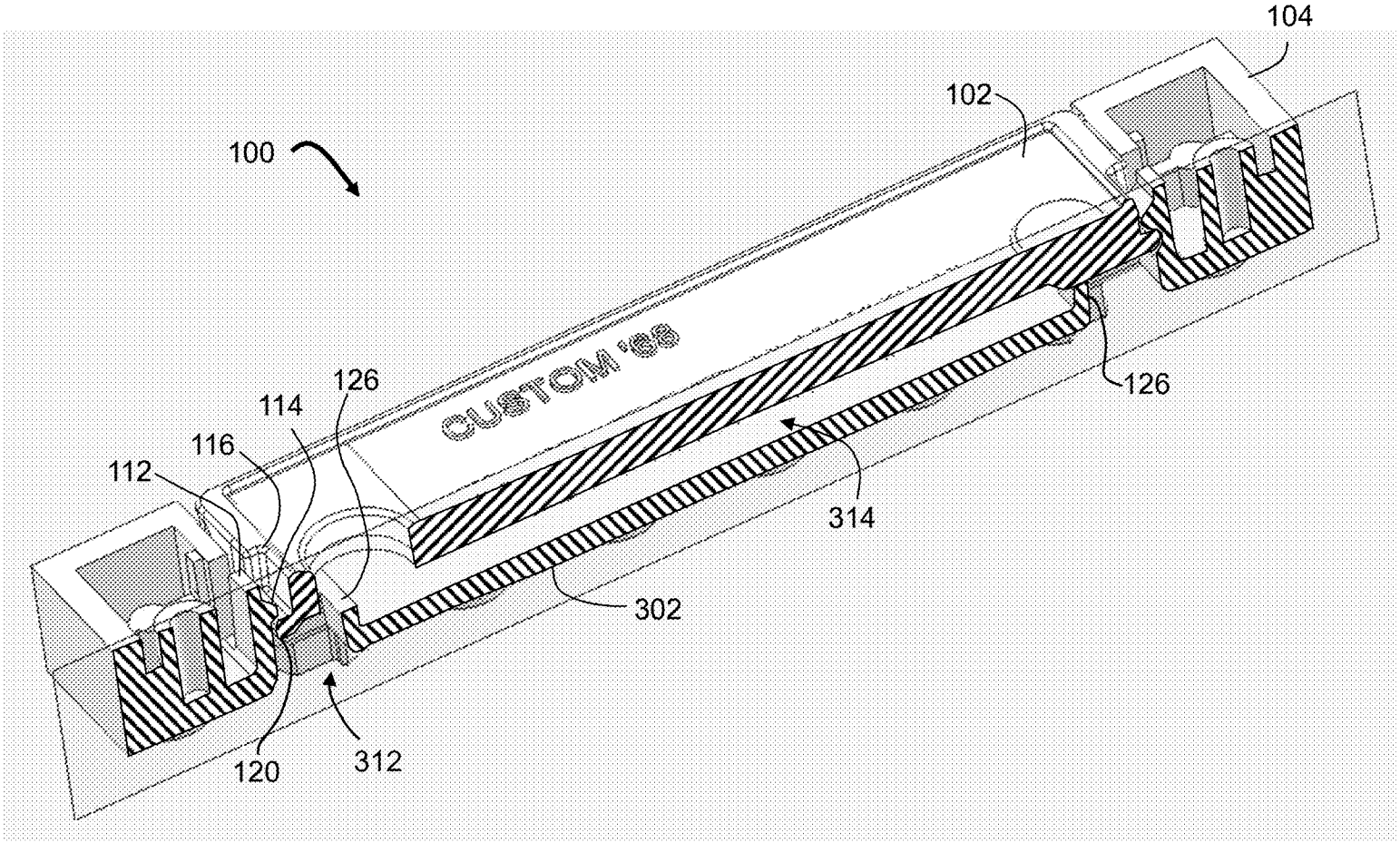
FIG. 6 is a schematic diagram that illustrates a cross-sectional perspective view of the construction set assembly of FIG. 1 in an assembled configuration, taken along line 6-6 of FIG. 2 (longitudinally with respect to the assembly), according to an embodiment.

As shown in FIGS. 1, 3, and 6, first construction element 102 may also include provisions for establishing regions of aligned and/or continuous contact with the second construction element 102 within nest opening 110, to provide a stable, secure connection. In embodiments, first construction element 102 may have a generally elongated cuboid shape including a plate portion 202 and a base portion 204. The plate portion 202 may have a rounded rectangular shape and include an interior recessed face 206, a first longitudinal rail 208, a second longitudinal rail 210 opposite to the first longitudinal rail 208, a first lateral rail 212, a second lateral rail 214 opposite to the first lateral rail 212, a first end portion 215, and a second end portion 217 opposite to the first end portion 215, with the end portions 215, 217 defining portions of the snap fit receiving portions 116. Base portion 204 may include a first foot portion 218, a second foot portion 220 opposite to the first foot portion 218, and an intermediate bridge portion 222 extending between the first foot portion 218 and the second foot portion 220. Each of the foot portions 218 and 220 may define further portions of the snap fit receiving portions 116.

Figure 5:
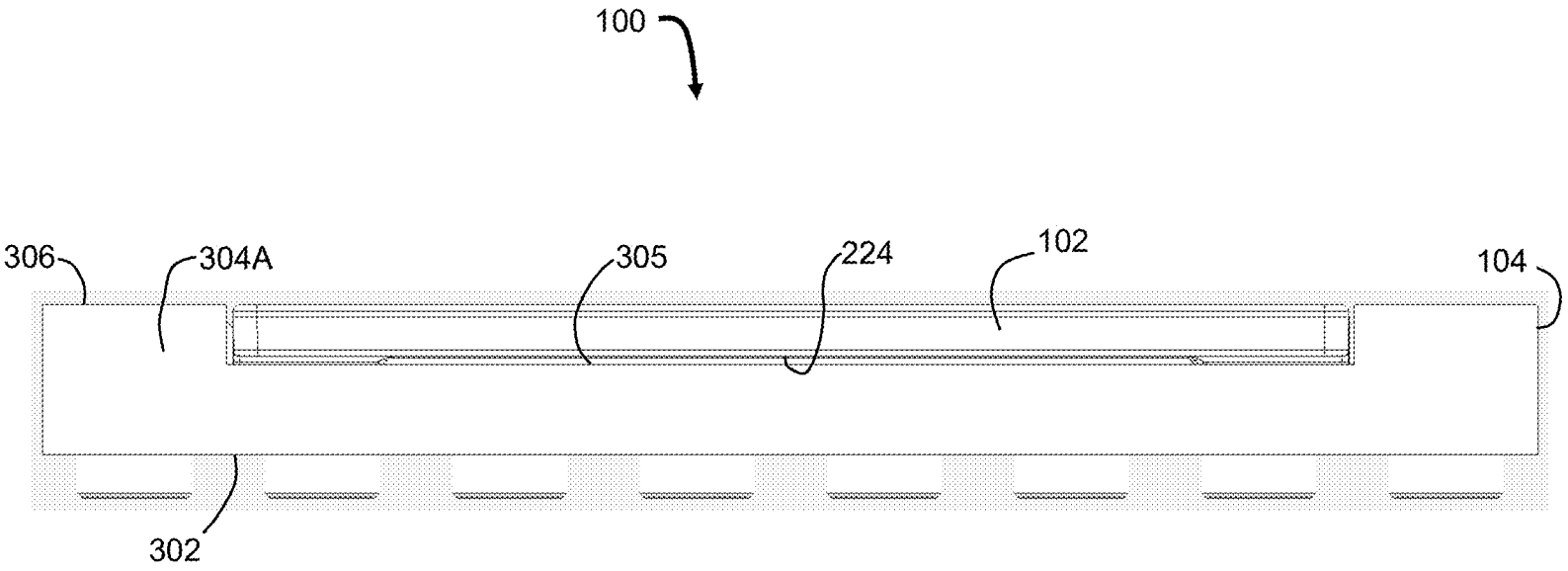
FIG. 5 is a schematic diagram that illustrates a side view of the construction set assembly of FIG. 1 in an assembled configuration, according to an embodiment.

Base portion 204 may have dimensions less than corresponding dimensions of the plate portion 202 to provide structures by which to support the first construction element 104 in mating with the second construction element 104. For example, as shown in FIG. 3, the foot portions 218, 220 and bridge portion 222 of base portion 204 may have widths less than a width of the plate portion 202 to provide ledges 224 of the first longitudinal rail 208 and the second longitudinal rail 210. In embodiments of a construction set assembly 100, ledges 224 may align with the bottom edges 305 of the notched portions of sidewalls 304 as shown in FIGS. 4 and 5 to provide a clean, squared appearance. In addition, ledges 224 may, though not necessarily, contact the bottom edges 305 to support the first construction element 102 within the nest opening 110 of the second construction element 104. Alternatively, as shown FIG. 5, ledges 224 may be spaced apart from bottom edges 305 and support may be provided by other portions of the base portion 204 and the second construction element 104. For example, as shown in FIGS. 1, 3, and 6, foot portions 218, 220 may be configured to fit between longitudinal walls 304 and rest on brace members 126 to support the first construction element 102, as the sole support. Foot portions 218, 220 may also be thicker than the bridge portion 222 to provide additional structural strength, while also allowing the bridge portion 222 to be thinner and thereby reducing manufacturing costs and reducing the weight of the first construction element 102 and construction set assembly 100. Foot portions 218, 220 may also facilitate an inset positioning of the first construction element 102 within the nest opening 110 that allows the first construction element 102 to nest within the cuboid boundary of the second construction element 104 (e.g., as defined by planes connecting the outermost eight vertices of second construction element 104), and thereby allow the construction assembly 100 to conform to a three-dimensional matrix of projecting pegs and coupling means of an interlocking construction set. In particular, the narrower widths of the foot portions 218, 220 may allow the base portion 204 to lower into the nest opening 110 in between the walls 304 until the foot portions 218, 220 contact the brace members 126, and the thicker proportions of the foot portions 218, 220 may allow for a lower positioning of the distal edge 120 to achieve proper positioning of the distal edge 120 under the hook protrusion 114 of the snap fitting 112.

In embodiments, the first construction element 104 may also include provisions for accessorizing a construction assembly with aesthetic and/or customized features. For example, interior recessed face 206 may include indicia 226, which may be printed, etched, embossed, or debossed on face 206. In embodiments, indicia 226 may be a part of the diecast of first construction element 206. Indicia 226 may include text, icons, logos, artwork, and graphic designs, for example, indicating the make and model of a vehicle and the logo of a manufacturer, for a first construction element 104 incorporated into an interlocking construction set representing a vehicle. In embodiments using raised indicia 226 that protrudes from the interior recessed face 206, the height of the indicia 226 may be equal to or less than the distance between the interior recessed face 206 and the uppermost surfaces of the plate portion 202 so that the first construction element 104 may conform to a three-dimensional matrix of projecting pegs and coupling means of an interlocking construction set. When incorporated into a toy vehicle construction set, the plate portion 202 of the first construction element 104, and its indicia 226, may serve as a chassis nameplate of the toy vehicle.

As shown in FIGS. 1-3, the first construction element 104 may also define an opening 228, which may provide another means of attachment of the first construction element 104. For example, a lanyard or keychain may be inserted through opening 228 so that a user may carry the first construction element 104 by itself. Alternatively, an attachment means could be disposed in the opening 228 while the first construction element 104 is connected to the second construction element 104 and possibly to other elements. For example, a thin string 230 could be looped through the opening 228 as shown in FIG. 3. Alternatively, a deformable plug attached to a leash could be pushed through the opening 228 and held securely in place by a friction fit between the plug and opening 228. With any such attachment means installed, the first construction element 102 may be connected to the second construction element 104 as shown in FIGS. 2 and 4 to carry the construction set assembly 100 as well as any other construction elements attached to assembly 100, including an entire construction set. In one embodiment, an entire toy vehicle construction set that incorporates the construction assembly 100 in the chassis of the vehicle could be carried using attachment means attached to opening 228.

In embodiments, opening 228 may have a circular cross-section providing a cylindrical shaped passageway through the first construction element 102, as shown in FIGS. 1-3 and 8. Alternatively, opening 228 may have other shapes such as rectangular, square, oval, or slotted.

In embodiments, opening 228 may also provide visual and/or physical access to the nest opening 110 of the second construction element 104. For example, as shown in FIGS. 2, 4, 6, and 8, nest opening 110 and portions of second construction element 104 may be visible and accessible through opening 228. In embodiments, a tool, such as a rod or screwdriver, may be inserted through opening 228 and between the first construction element 102 and the second construction element 104 and maneuvered to pry or lever the first construction element 102 away from the second construction element 104. For example, as shown in the plan view at the top of FIG. 8, a tool may be inserted between an edge of opening 228 and brace member 126 and then pushed to provide a prying or levering action to help separate elements 102 and 104.

Figure 8:
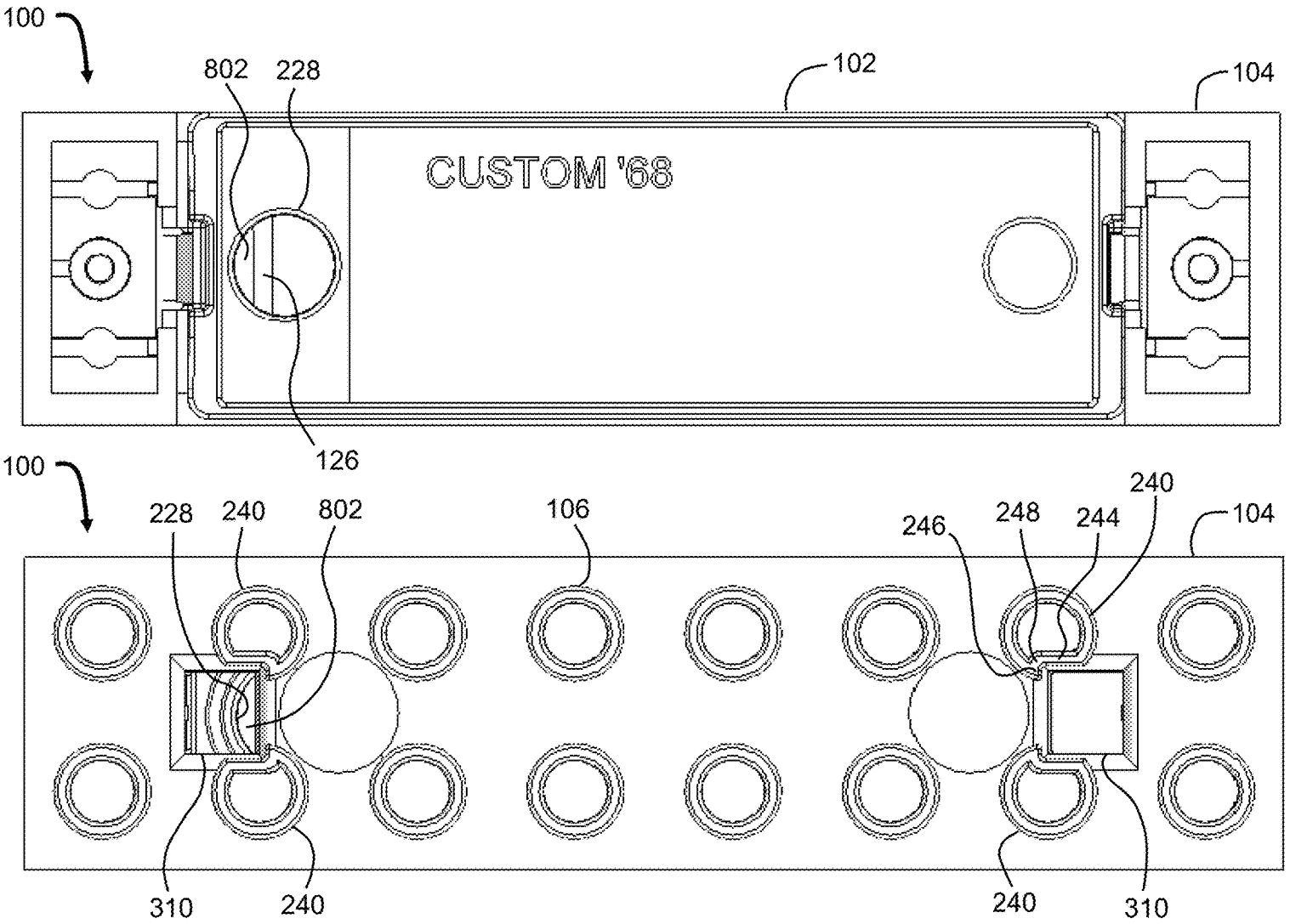
FIG. 8 is a schematic diagram that illustrates a first plan view (at top of FIG. 8) and an opposite plan view (at bottom of FIG. 8) of the construction set assembly of FIG. 1 in an assembled configuration, according to an embodiment.

Similarly, in embodiments, openings 310 of the second construction element 104 may provide visual and/or physical access to nest opening 110 of the second construction element 104. For example, as shown in FIGS. 4, 6, and 8, nest opening 110 and portions of first construction element 102 may be visible and accessible through openings 310. In embodiments, a tool, such as a rod or screwdriver, may be inserted through openings 310 and between the first construction element 102 and the second construction element 104 and maneuvered to pry or lever the first construction element 102 away from the second construction element 104. For example, as shown in the plan view at the bottom of FIG. 8, a tool may be inserted between an edge of openings 310 and the base portion 204 of first construction element 102 and then pushed to provide a prying or levering action to help separate elements 102 and 104.

Embodiments may also include provisions for aligned openings through a construction set assembly 100, which may be used to connect other construction elements or to provide a single attachment for both elements 102 and 104. For example, as shown in FIG. 8, an attachment means, such as a lanyard, a keychain, or a string as discussed above, may be inserted through a passageway 802 including both opening 228 and opening 310. By connecting an attachment means in this manner to both elements 102, 104, an attachment means may be able to more securely carry construction set assembly 100.

To provide an opening through the upper wall 302 of the second construction element 104, embodiments may include provisions for positioning the opening at a desired location while maintaining the connection capabilities of the projecting pegs on the upper wall 302. For example, as shown in FIGS. 3, 4, and 8, projecting pegs 240 adjacent to the opening 310 may have an incomplete cylindrical shape that includes interrupting walls 242 aligned with sides of the opening 310. The walls 242 may project perpendicularly from the upper surface of the upper wall 302 and may be disposed around a corner of the opening 310, with a longer straight section 244 and shorter straight section 246 connected by a rounded corner section 248, as shown in FIG. 8. The interrupting walls 242 may accommodate formation of and access to an opening 310, for example, for injection molding purposes or for access by tools or attachment means, as described above. At the same time, by limiting the interrupting walls 242 to only a portion of a projecting peg 240, the remaining portions of the cylindrical structure of the projecting peg 240 may be used for connection with coupling means in conjunction with the other projecting pegs of the upper surface of the upper wall 302. In particular, as shown in FIG. 8, the remaining portions of the projecting pegs 240 may conform to the uniform positioning of all the projecting pegs 106 within the designated matrix of a construction set having projecting pegs and coupling means. Although in this embodiment the interrupting walls 242 are shown with straight sections that align with straight sides of the openings 310, other shapes are possible depending, for example, on the shape of an opening 310. For example, if an opening 310 is circular, interrupting walls 242 may be arc-shaped to align with the perimeter of the circular opening 310.

Figure 9:
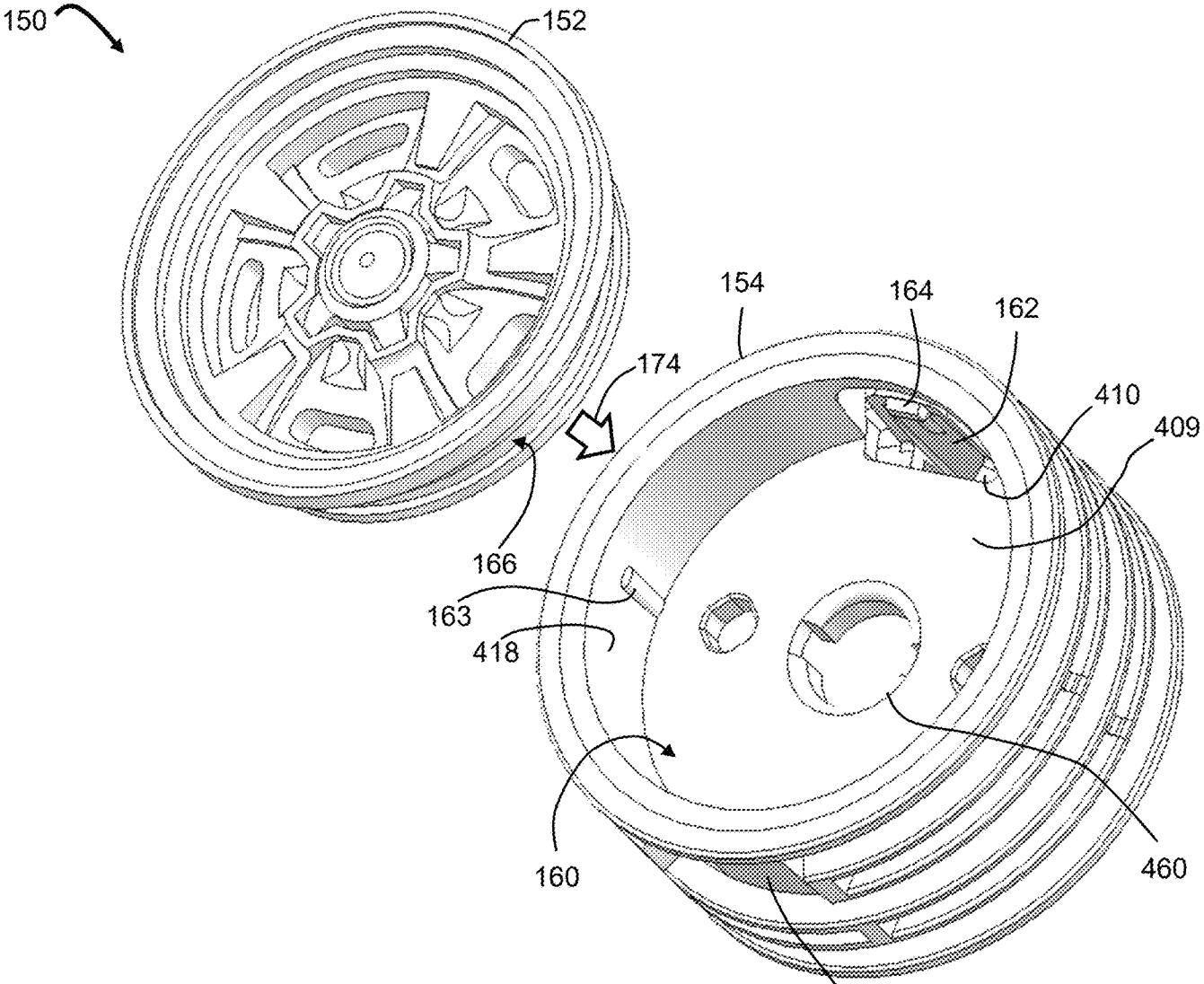
FIG. 9 is a schematic diagram that illustrates a perspective view of a construction set assembly in a disassembled configuration, in accordance with a second embodiment.
Figure 10:
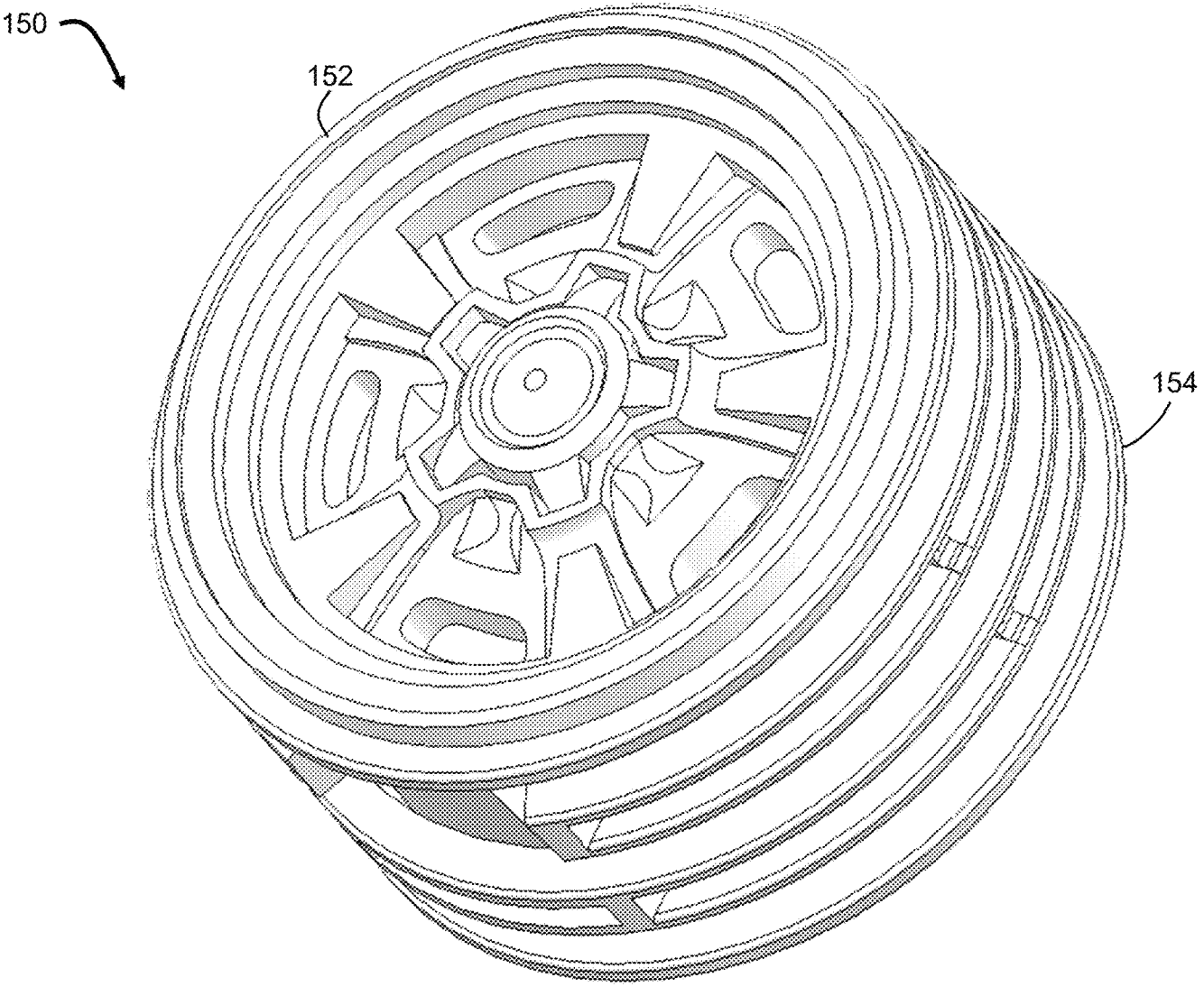
FIG. 10 is a schematic diagram that illustrates a perspective view of the construction set assembly of FIG. 9 in an assembled configuration, according to an embodiment.
Figure 11:
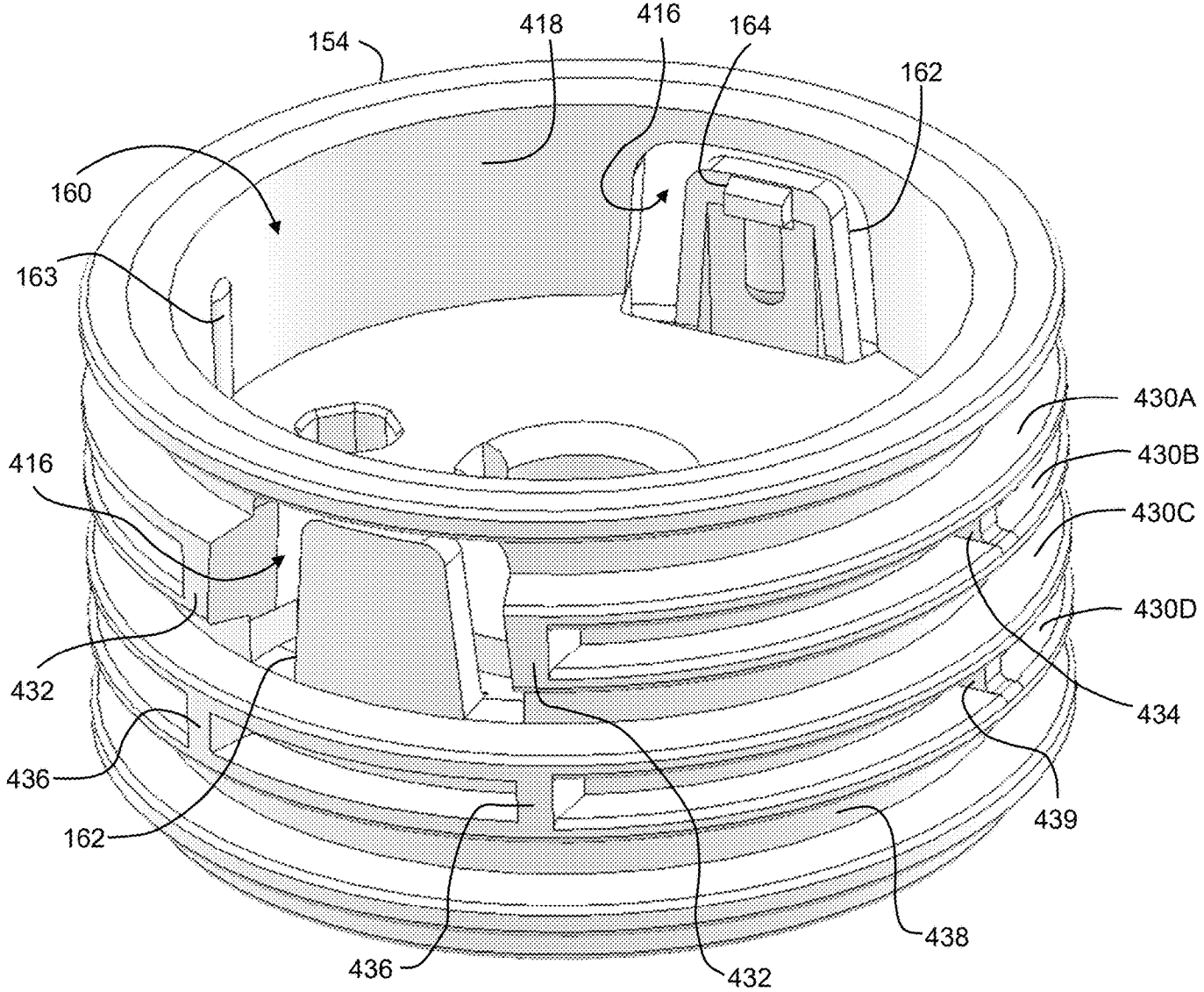
FIG. 11 is a schematic diagram that illustrates a perspective view of the second construction element of the construction set assembly of FIG. 9, according to an embodiment.
Figure 12:
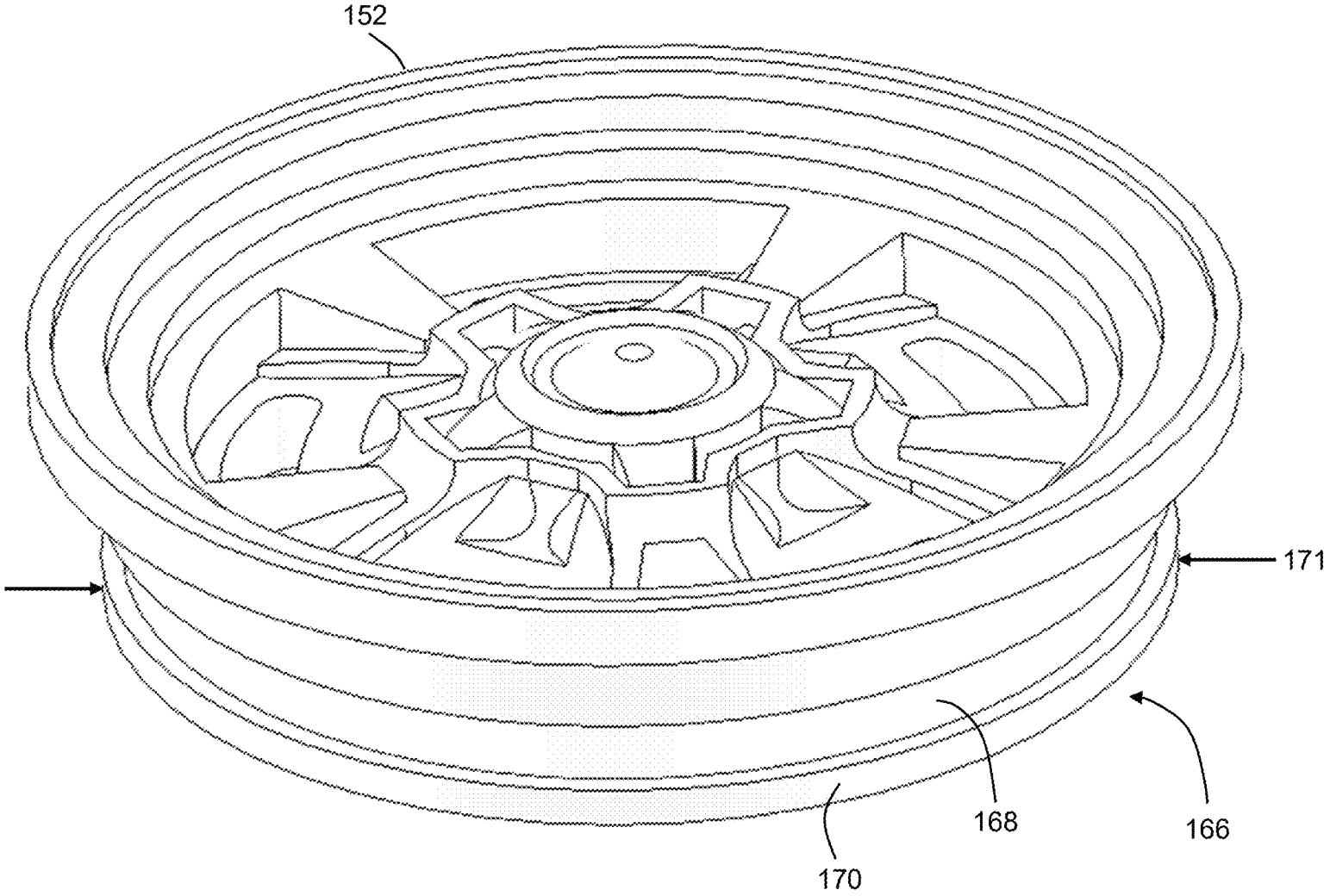
FIG. 12 is a schematic diagram that illustrates a perspective view of the first construction element of the construction set assembly of FIG. 9, according to an embodiment.
Figure 13:
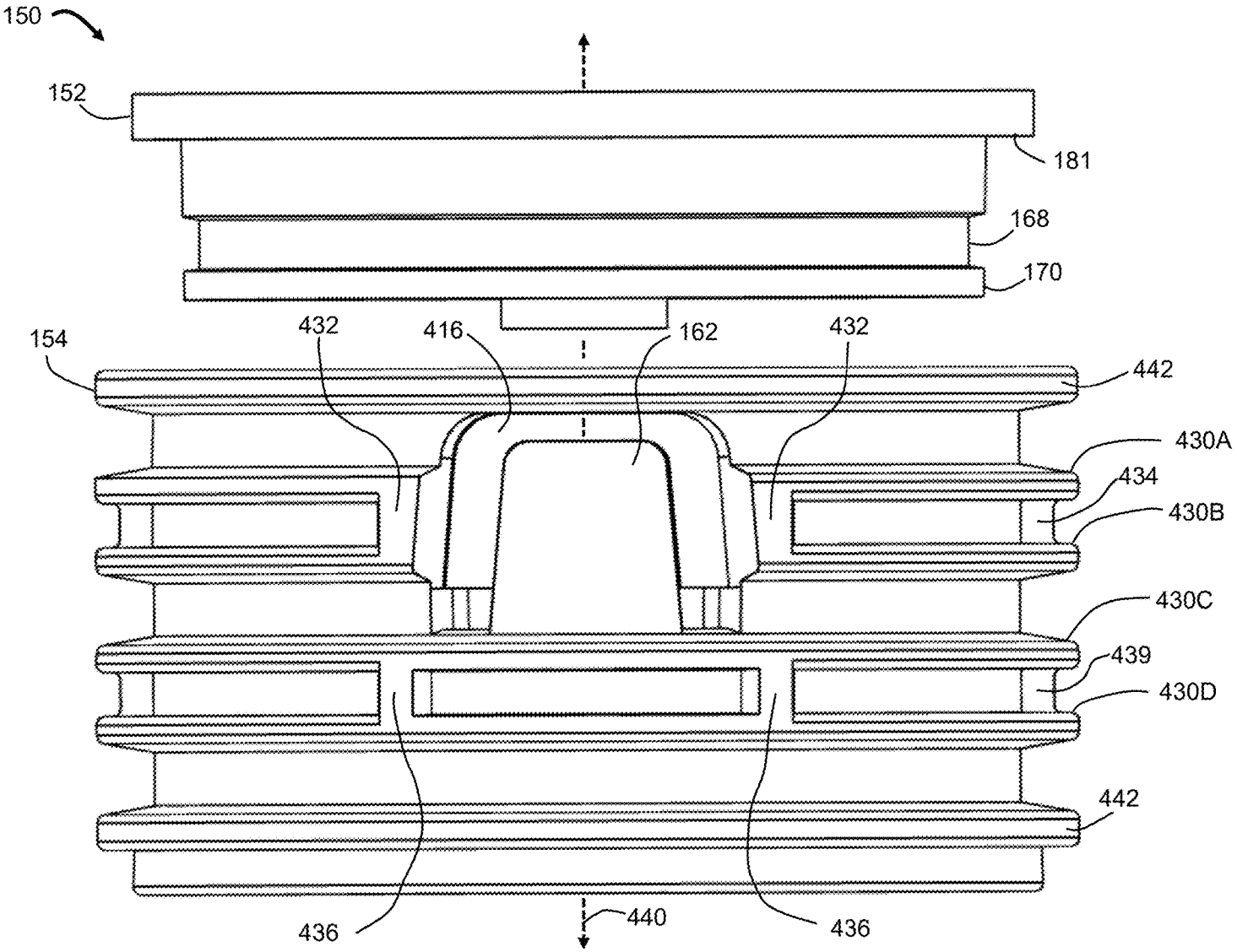
FIG. 13 is a schematic diagram that illustrates a side view of the construction set assembly of FIG. 9 in a disassembled configuration, according to an embodiment.
Figure 16:
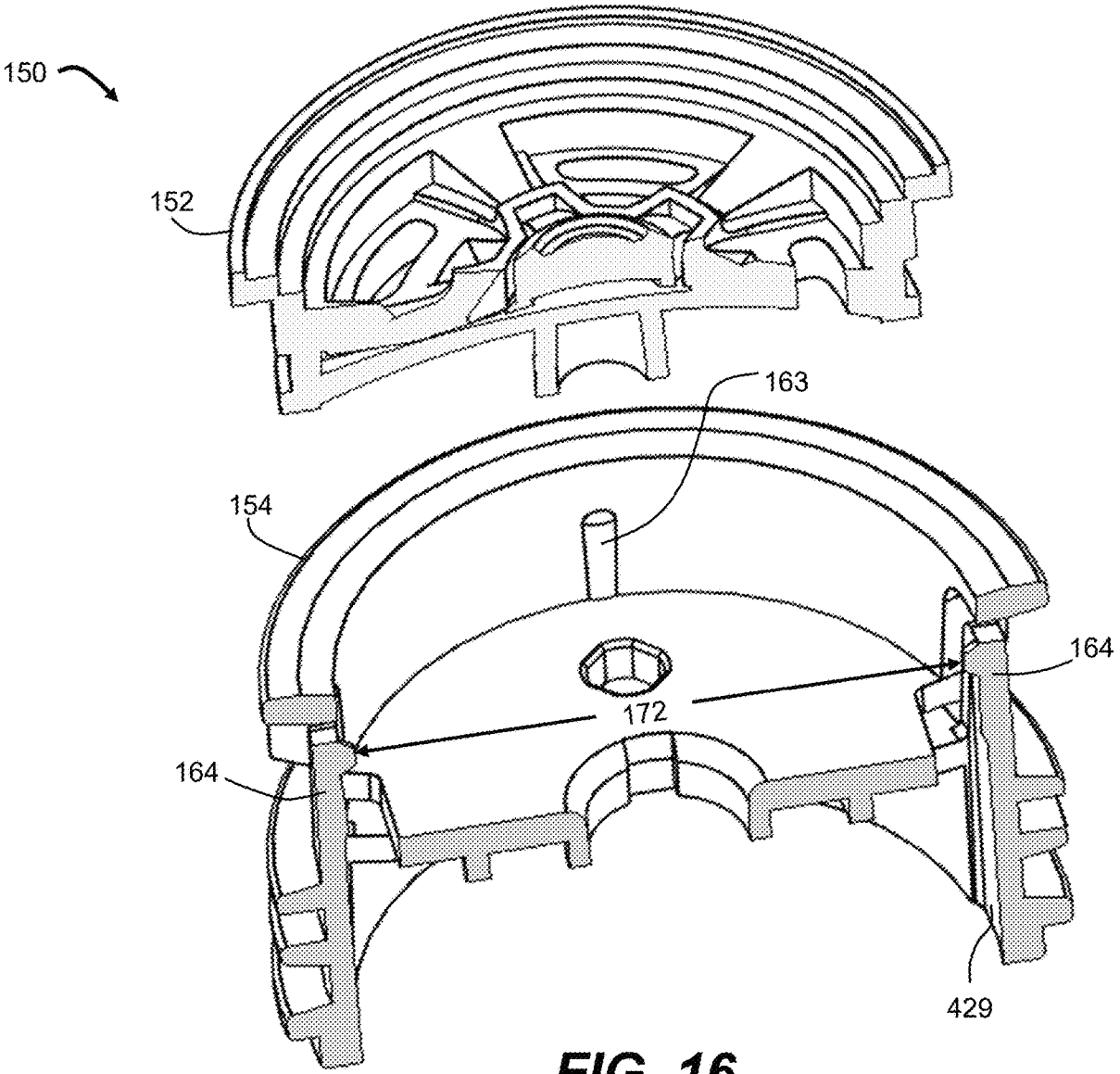
FIG. 16 is a schematic diagram that illustrates a cross-sectional perspective view of the construction set assembly of FIG. 9 in a disassembled configuration, taken along line 16/17-16/17 of FIG. 15, according to an embodiment.

FIGS. 9-22 illustrate another embodiment of a construction set assembly 150 having two construction elements made of different materials. In this embodiment, the construction elements may have a cylindrical shape, such as a wheel hub cap and a complementary wheel configured to receive the wheel hup cap. FIGS. 9, 13, and 16 are schematic diagrams that depict exploded, or disassembled, views of an embodiment of a construction set assembly 150. FIGS. 10, 14, 15, 17, and 18 are schematic diagrams that depict assembled views of the construction set assembly 150 of FIGS. 9, 13, and 16. FIGS. 11, 12, and 19-22 are schematic diagrams that depict in isolation the individual elements of the construction set assembly 150. Referring to FIGS. 9, 13, and 16, the construction set assembly 150 may comprise a first construction element 152 and a second construction element 154. Alternatively, a construction set assembly could include additional elements, including other interlocking elements, cylindrical, block-like, or otherwise, joined together in a build, such as a build representing an automobile or other vehicle.

First construction element 152 and second construction element 154 may be made of different materials and include provisions for a detachable connection between the elements that minimizes permanent deformation, marring, or other damage to the construction elements. In an embodiment, referring to FIG. 9, relative to each other, first construction element 152 may be made of a stronger and more durable material, such as metal (e.g., zinc), and formed as a cylindrical disc, and second construction element 154 may be made of a more flexible yet also durable material, such as plastic, and formed as a cylindrical wheel having provisions for connecting with other like construction elements, such as a tire and a rod or axle. In embodiments, first construction element 152 may be made of a zinc alloy and second construction element 154 may be made of acrylonitrile butadiene styrene ("ABS").

To provide a detachable connection, second construction element 154 may define an opening 160 configured to receive first construction element 152. In embodiments, opening 150 may be shaped similarly to first construction element 152 and sized slightly larger than first construction element 152, so that first construction element 152 may fit snugly within opening 160 to minimize relative movement between the elements. As shown in FIG. 9, second construction element 154 may include wall protrusions 163 (in this example, two wall protrusions opposite to each other) that may contact an outer perimeter of the first construction element 152 to promote a tighter fit. To further secure the construction elements 152 and 154, while still allowing for convenient disassembly, construction elements 152 and 154 may include one or more detachable fittings, such as interference fittings, press-fit fittings, or snap fittings. For example, as shown in the embodiment of FIGS. 9, 11, and 12, second construction element 154 may include one or more deflectable cantilever snap fittings 162, each of which connects to a snap fit receiving portion 166 of the first construction element 152. A snap fit receiving portion 166 may include a proximal recess 168 and a distal edge 170. In embodiments, the proximal recess 168 may be an annular groove around a cylindrical-disc-shaped first construction element and the distal edge 170 may be an annular ring around a cylindrical-disc-shaped first construction element. A cantilever snap fitting 162 may have a hook protrusion 164 that protrudes into the interior of the opening 160. In embodiments, first construction element 152 has a dimension 171 (see FIG. 12), in this example the diameter, that is received within the opening 160 of second construction element 154 and is greater than a distance 172 (see FIG. 16) between a hook protrusion 164 and another structure of the second construction element 154 defining the opening 150, which could be a wall or as in the example of FIGS. 9 and 16, another opposing hook protrusion of another deflectable cantilever snap fitting 162.

Figure 14:
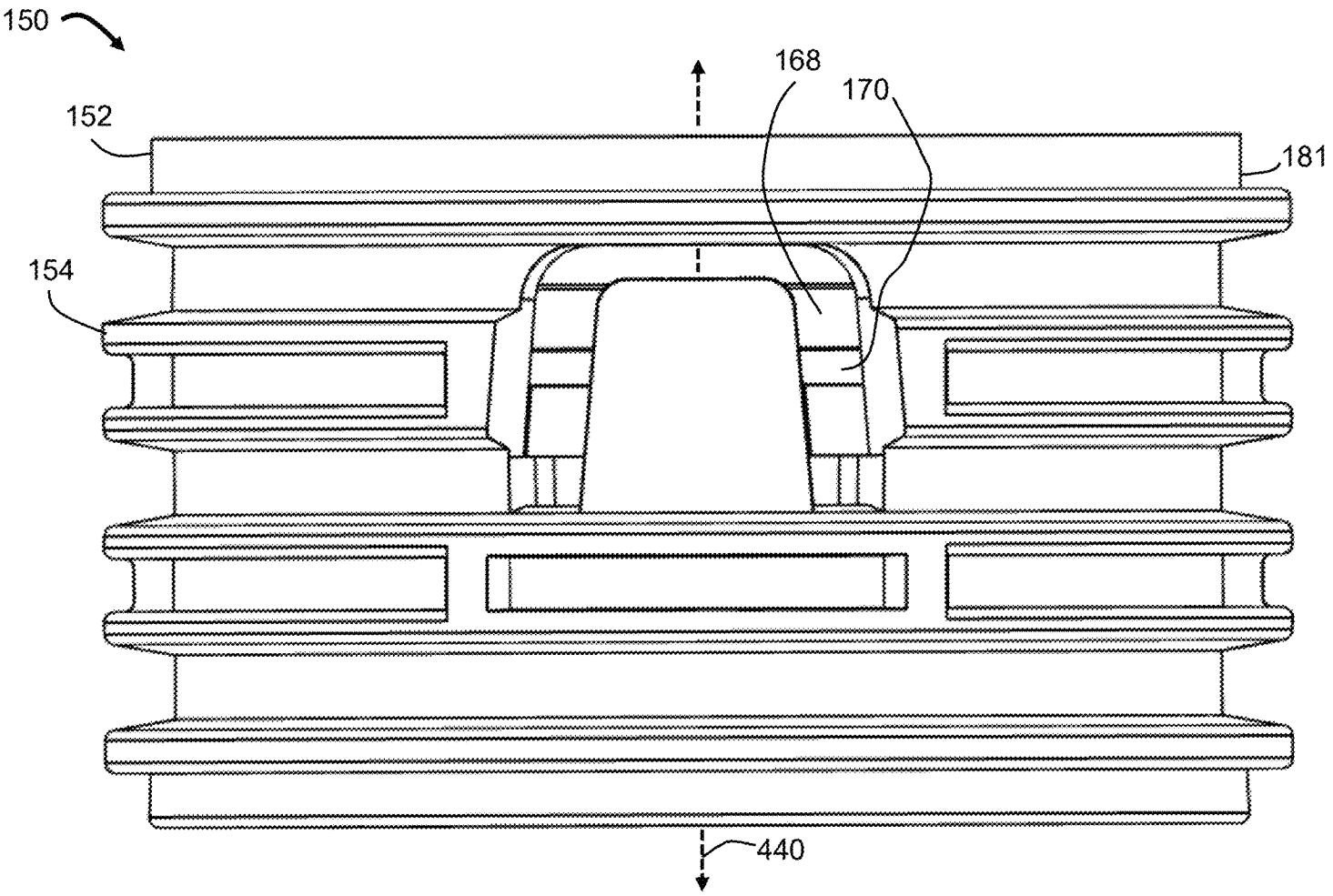
FIG. 14 is a schematic diagram that illustrates a side view of the construction set assembly of FIG. 9 in an assembled configuration, according to an embodiment.
Figure 15:
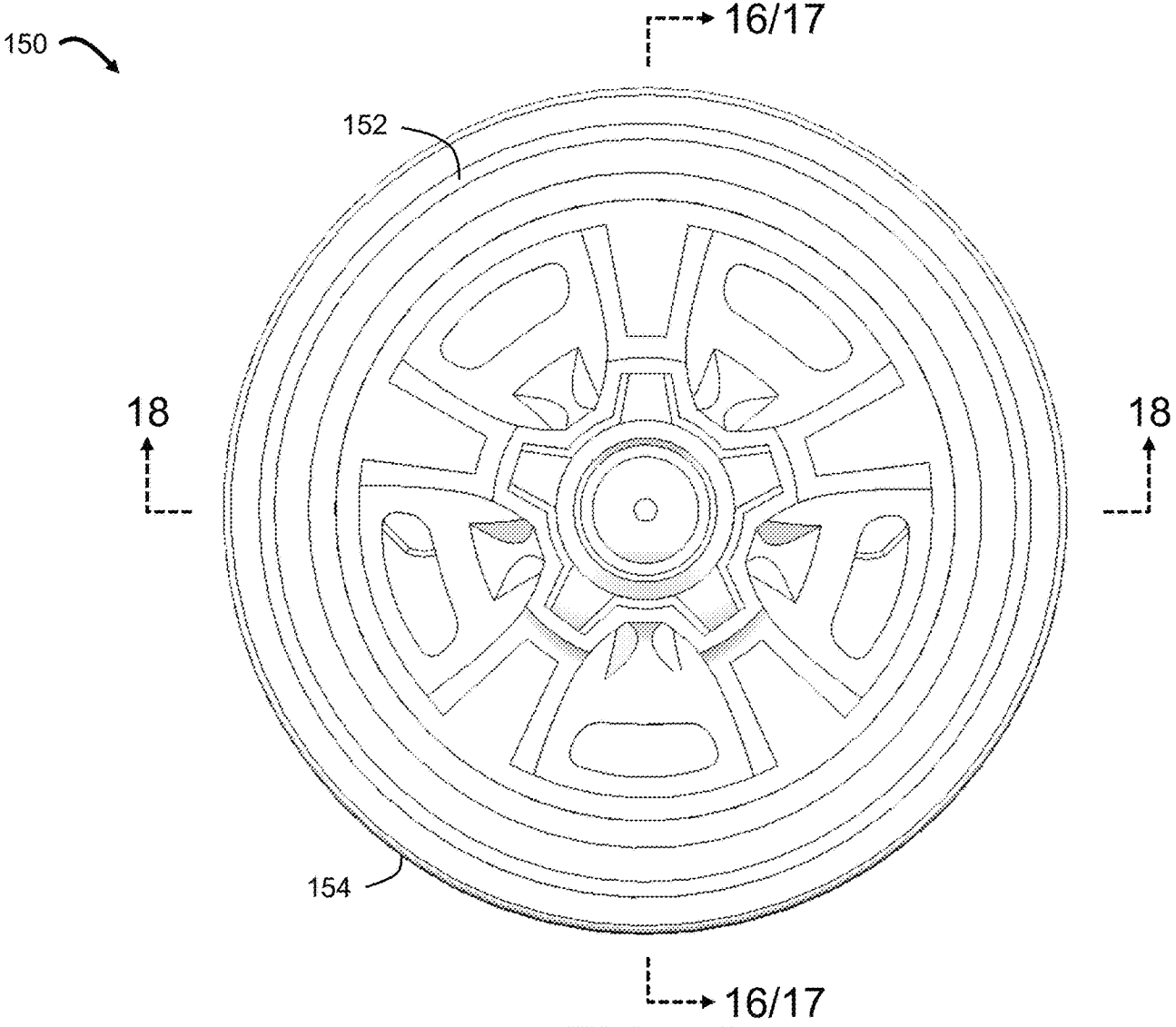
FIG. 15 is a schematic diagram that illustrates a top plan view of the construction set assembly of FIG. 9 in an assembled configuration, according to an embodiment.

In embodiments, different relative dimensions, such as between distances 171 and 172, may permit the establishment of a detachable connection by temporarily deflecting a snap fitting of a deflecting construction element with a fixed construction element, and then allowing the snap fitting to return to its original position, with a portion of the snap fitting disposed in a receiving portion of the fixed construction element. For example, as represented by arrow 174 in FIG. 9, first construction element 152 may be inserted into opening 160 such that the distal edge 170 contacts the hook protrusions 164 and pushes the hook protrusions 164 outward, thereby deflecting the free ends of the cantilever snap fittings 162 away from the interior of opening 160 to allow passage of the first construction element 152 into the opening 160. When the distal edge 170 passes beyond the hook protrusions 164 and further into opening 160, the free ends of the cantilever snap fittings 162 may move back toward the interior of the opening 160 and return toward their original position, at which point the hook protrusions 164 are disposed within the proximal recess 168 of the snap fit receiving portions 166 of the first construction element 152, as shown in FIG. 9 and in the cross-sectional perspective view of FIG. 17. In embodiments, the thickness of a distal edge 170 and the position of a hook protrusion 164 may be configured such that, when the first construction element 152 is nested within the opening 160, the hook protrusion 154 presses against the distal edge 170 to keep the first construction element 152 securely connected to the second construction element 154. As shown in FIGS. 13 and 14, first construction element 152 may have an upper flange 181 that is wider than the opening 160 and configured to rest on the upper rail 442 of the second construction element 154 when the first construction element 152 is connected to the second construction element 154.

Figure 19:
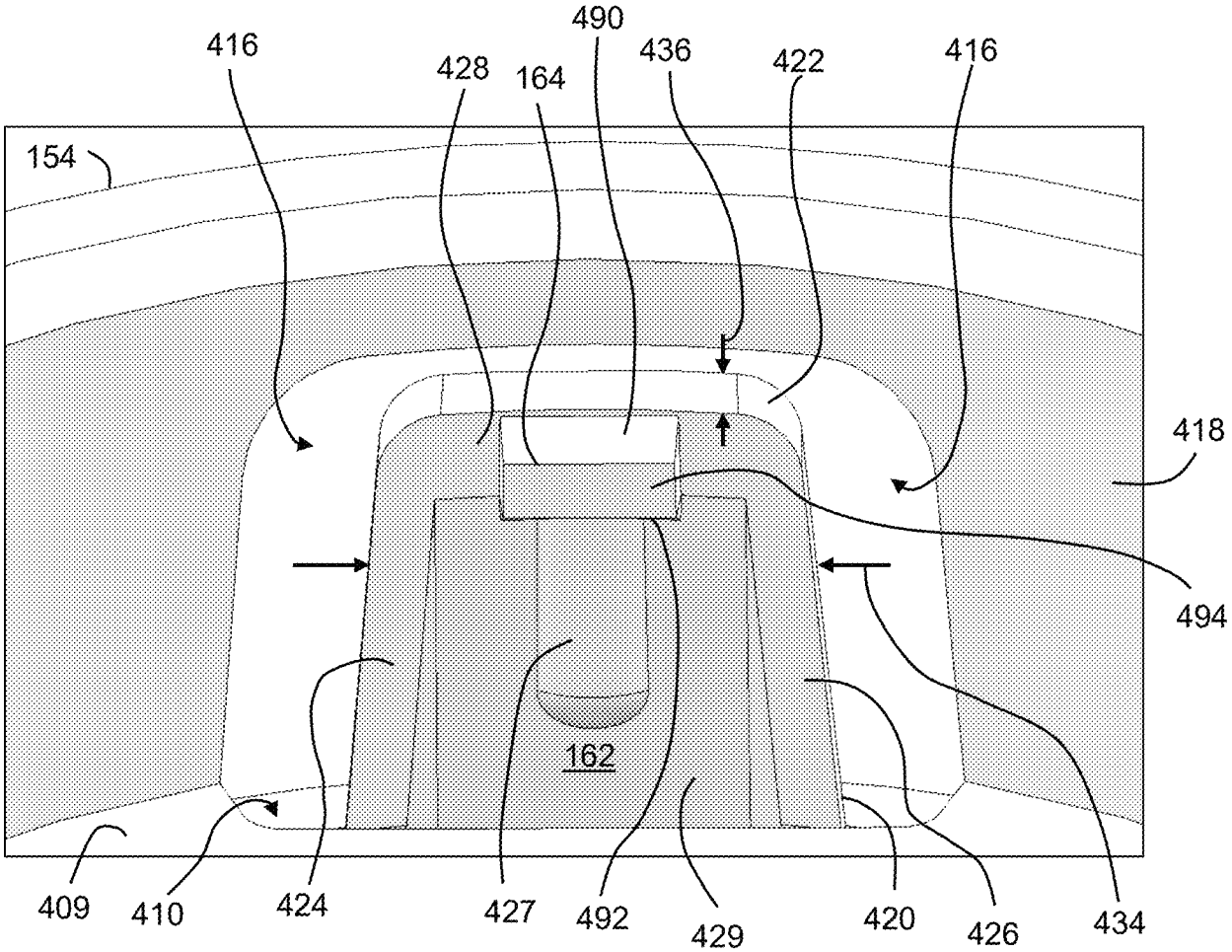
FIG. 19 is a schematic diagram that illustrates an enlarged partial view of the snap fitting of the second construction set element of the construction set assembly of FIG. 9, according to an embodiment.

FIG. 19 illustrates an enlarged partial perspective view of one cantilever snap fitting 162 of the second construction element 154 from within the opening 160, according to an embodiment. As shown, cantilever snap fitting 162 may be formed by openings in a wall of second construction element 154, such as openings 416 in an interior wall 418 in this embodiment. Snap fitting 162 may extend from an attached end 420 to a free end 422 that is unsupported and deflectable, and have a first side perimeter face 424, a second side perimeter face 426 opposite to the first side perimeter face 424, and a top side perimeter face 428 spanning the first side perimeter face 424 and the second side perimeter face 426. The perimeter faces 424, 426, 428 may be in line with the inside face of the interior wall 418, for example, having the same curvature as the interior wall 418 and being disposed on the same circumference as the interior wall 418 such that if the openings 416 were not present the perimeter faces 424, 426, 428 would be continuous with the cylindrical shape of the interior wall 418. At the attached end 420, the second construction element 154 may have an interior base wall 409 disposed inside the cylindrical body 438 and perpendicular to the longitudinal axis 440 (see FIGS. 13 and 14) of the cylindrical wall 418 and cylindrical body 438 of the second construction element 154, which defines an opening 410 at the attached end 420.

Snap fitting 162 may also increase in width 434 and thickness 436 from the free end 422 to the attached end 420. The increasing width 434 may allow at the free end 422 greater separation between the snap fitting 162 and the interior wall 418 for more unobstructed movement, while also providing a wider base at the attached end 420 for a stronger, more durable connection to the cylindrical body 438 of the second construction element 154. The increasing thickness 436 may also provide a stronger, more durable connection to the cylindrical body 438 of the second construction element 154.

The hook protrusion 164 of snap fitting 162 may protrude toward the interior of the nest opening 160 and may have a first flat face 490 outwardly angled from the top side perimeter face 428 of the snap fitting 162, a second opposing flat face 492 outwardly angled from the top side perimeter face 428, and a third immediate flat face 494 between and connecting the first and second flat faces and facing the interior of the opening 160. The interior recessed surface 429 of snap fitting 162 may be angled outwardly away from the opening 160 moving in a direction from the free end 422 to the attached end 420, which may provide benefits of more convenient injection molding and mold release, while the snap fitting 162 may increase in thickness 436 along the first side perimeter face 424 and the second side perimeter face 426 moving in a direction from the free end 422 to the attached end 420, which may provide surprising benefits in increasing the strength and durability of the snap fitting 162 at its base and avoiding potentially weaker stress points, e.g., sharp corners subject to cracking.

Snap fitting 162 may also include a pad 427 on the interior recessed surface 429 disposed between the hook protrusion 164 and the attached end 420, which may facilitate mold release, as well as serve as a wear pad that the distal edge 170 of the first construction element 152 may contact, to avoid wear and other damage to the snap fitting 162. Although the embodiment of FIG. 19 illustrates a snap fitting 162 having a generally trapezoidal shape, an interior wall 418 having a generally cylindrical shape, and an opening 410 having a generally pill shape (see, e.g., FIG. 20), other shapes, sizes, and proportions are possible, including more rounded geometries.

Although embodiments of FIGS. 9-21 include two cantilever snap fittings 162 on the second construction element 154, other embodiments may include just one snap fitting or more than two snap fittings. As an example using one snap fitting, referring to FIG. 9, the second construction element 154 could be modified from what is shown, to have a snap fitting 162 on only the far side shown in FIG. 9 and an alternative connection means on the opposite, near side, such as a fixed hook or overhang under which the snap fit receiving portion 166 of the first construction element 152 can be inserted and held. With that modified configuration, the near end of the first construction element 152 may be slid under the alternative connection means and then the far end of the first construction element 152 may be rotated around the fixed right near end to lower the far end down to temporarily deflect the snap fitting 162 and engage the snap fitting 162 with the first construction element 152 disposed in the opening 160 and connected to the second construction element 154, as described above. As an example using more than two snap fittings 162, referring to FIGS. 9, 19, and 20, in addition to the snap fittings 162 on the near and far sides of the second construction element 154, one or more snap fittings may be added to the cylindrical wall 418 of the second construction element 154; for example, a third snap fitting could be added to the cylindrical wall 418 at a location 180 midpoint between the existing two snap fittings 162 and a fourth snap fitting could be added to the cylindrical wall 418 at a location 182 midpoint between the existing two snap fittings 162 opposite to location 180, such that four snap fittings are provided at approximately 90 degree positions around the circular cross-section of the second construction element 154.

In embodiments, the second construction element 154 may include provisions for securely supporting the first construction element 152 within the opening 160 and for providing additional structural integrity to the second construction element 154 to compensate for the typical portions of a cylindrical construction element that are omitted to create the snap fittings 162 in the cylindrical wall 418 and the interior base wall 409 of the second construction element 154. For example, referring to FIGS. 11 and 13, to compensate for the openings 416 in the cylindrical wall 418, embodiments may may include annular ribs that stiffen and strengthen the cylindrical body 438. For example, cylindrical body 438 may include a first annular rib 430A and a second annular rib 430B that extend circumferentially around the cylindrical body 438 and are interrupted at the openings 416 for the snap fittings 162. For additional strength, embodiments may include end struts 432 connecting the ribs 430A, 430B adjacent to the openings 416, and intermediate struts 434 connecting the ribs 430A, 430B at locations 180, 182 midpoint between the snap fittings 162. For additional strength and rigidity, as shown in FIGS. 11 and 13, cylindrical body 438 may further include a third annular rib 430C and a fourth annular rib 430D that extend circumferentially around the cylindrical body 438 without interruption and include opening struts 436 that are disposed adjacent to openings 416 and are generally aligned with end struts 432 longitudinally with respect to the longitudinal axis 440 of the first and second construction elements 152, 154, and intermediate struts 439 connecting the ribs 430C, 430D at locations 180, 182 midpoint between the snap fittings 162. In addition to increasing strength and rigidity, the ribs may also help secure a tire that is installed around the second construction element 154 and disposed between the outer rails 442.

Figure 17:
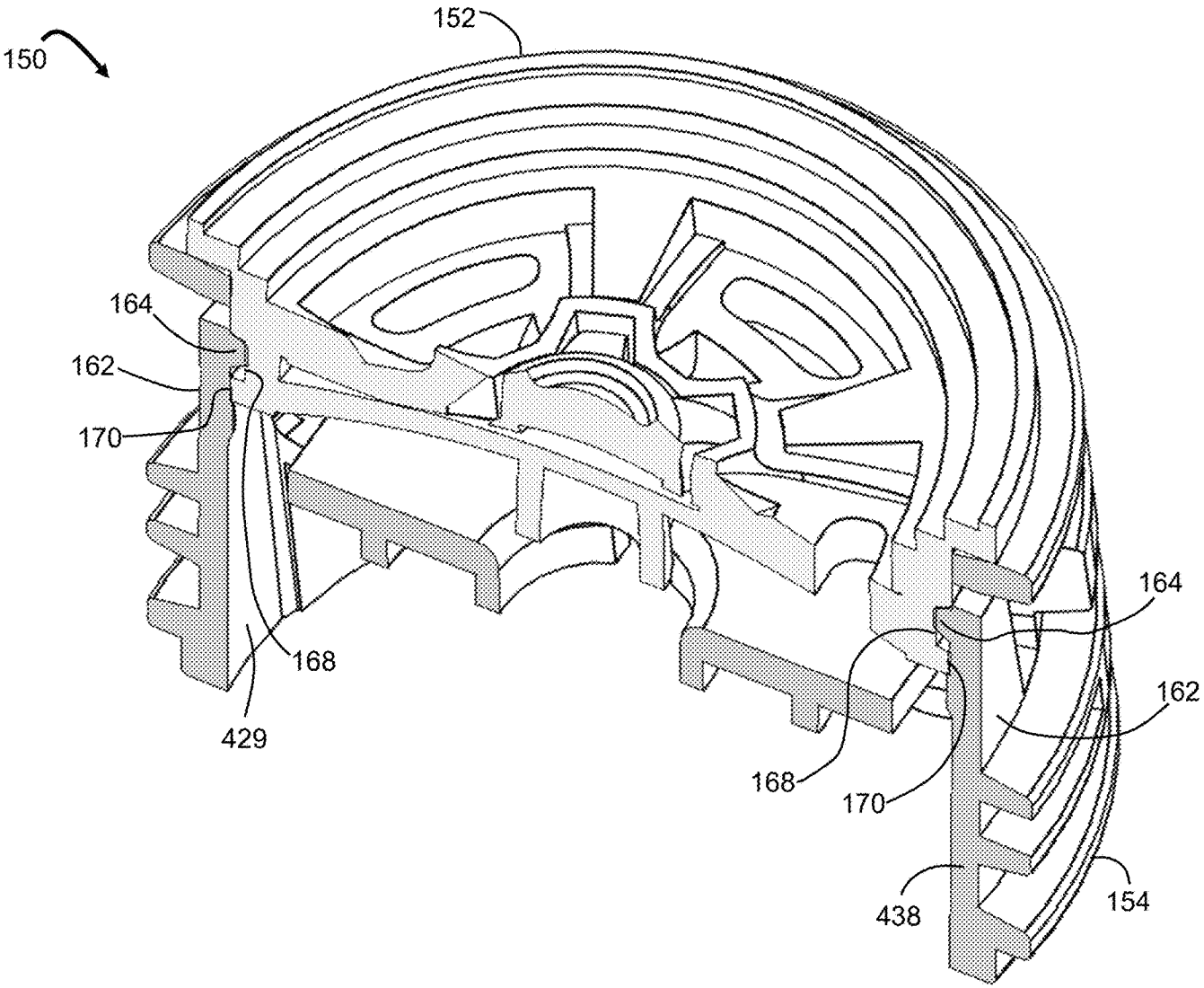
FIG. 17 is a schematic diagram that illustrates a cross-sectional perspective view of the construction set assembly of FIG. 9 in an assembled configuration, taken along line 16/17-16/17 of FIG. 15, according to an embodiment.
Figure 18:
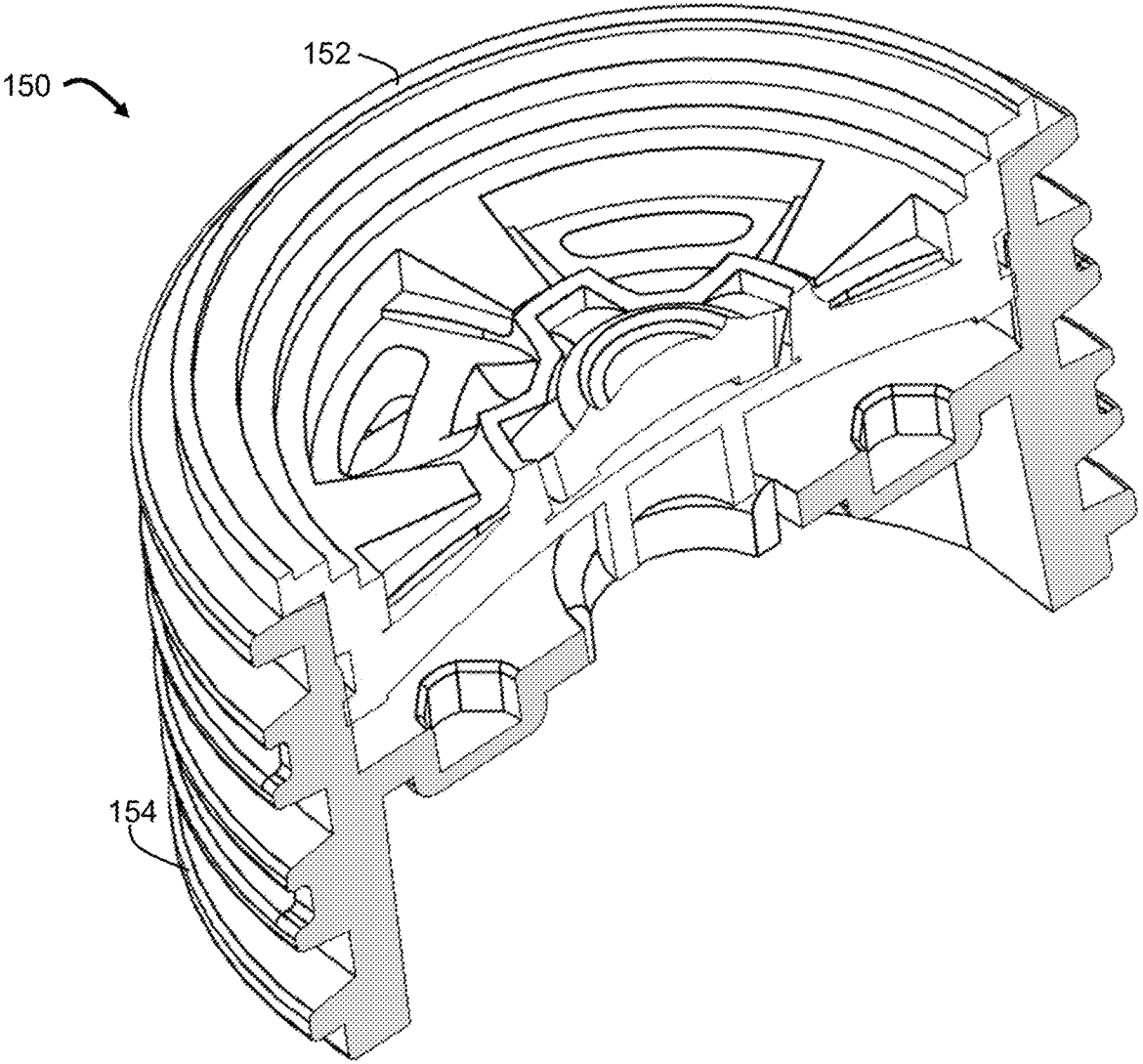
FIG. 18 is a schematic diagram that illustrates a cross-sectional perspective view of the construction set assembly of FIG. 9 in an assembled configuration, taken along line 18-18 of FIG. 15, according to an embodiment.
Figure 20:
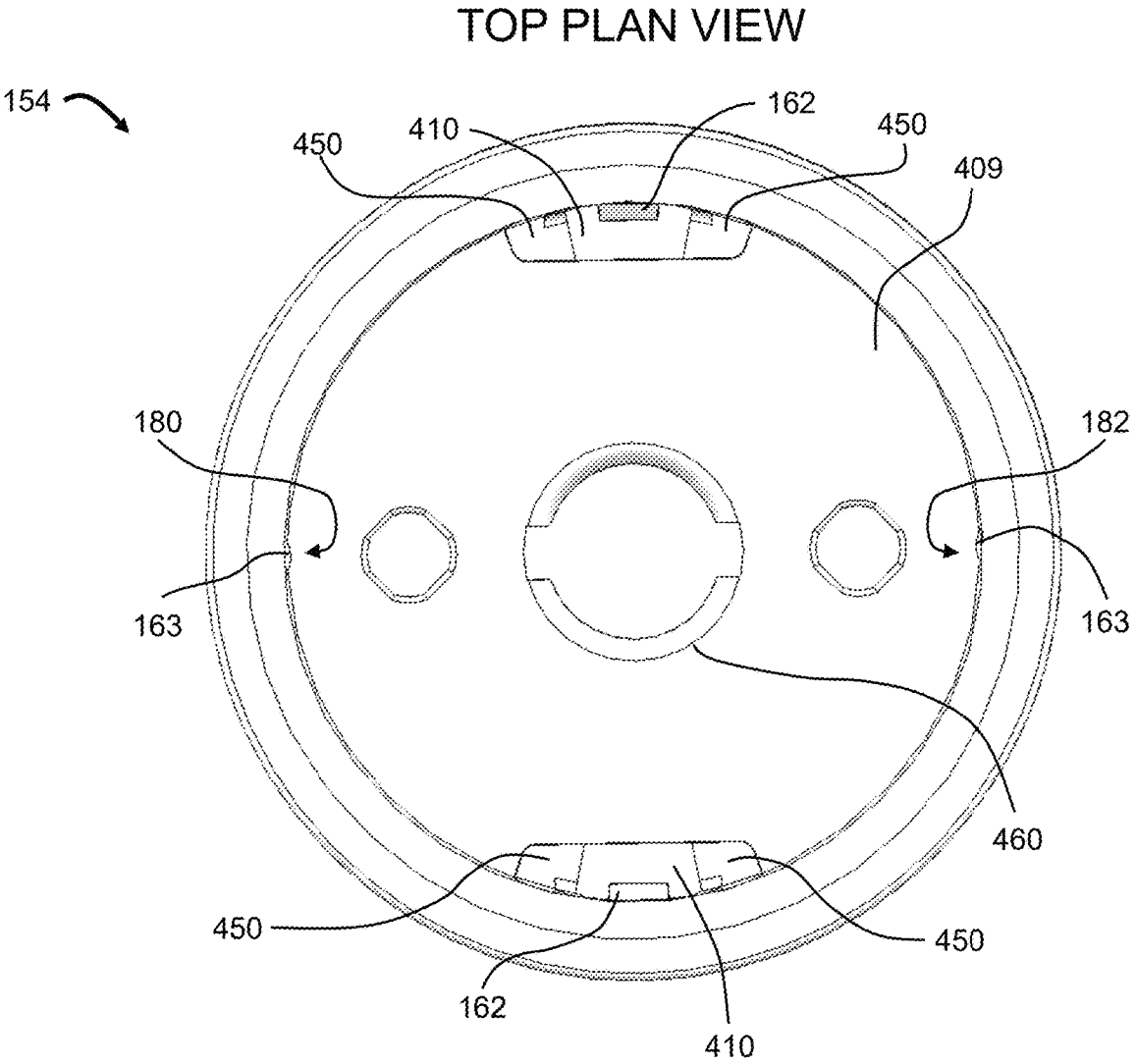
FIG. 20 is a schematic diagram that illustrates a top plan view of the second construction set element of the construction set assembly of FIG. 9, according to an embodiment.
Figure 21:
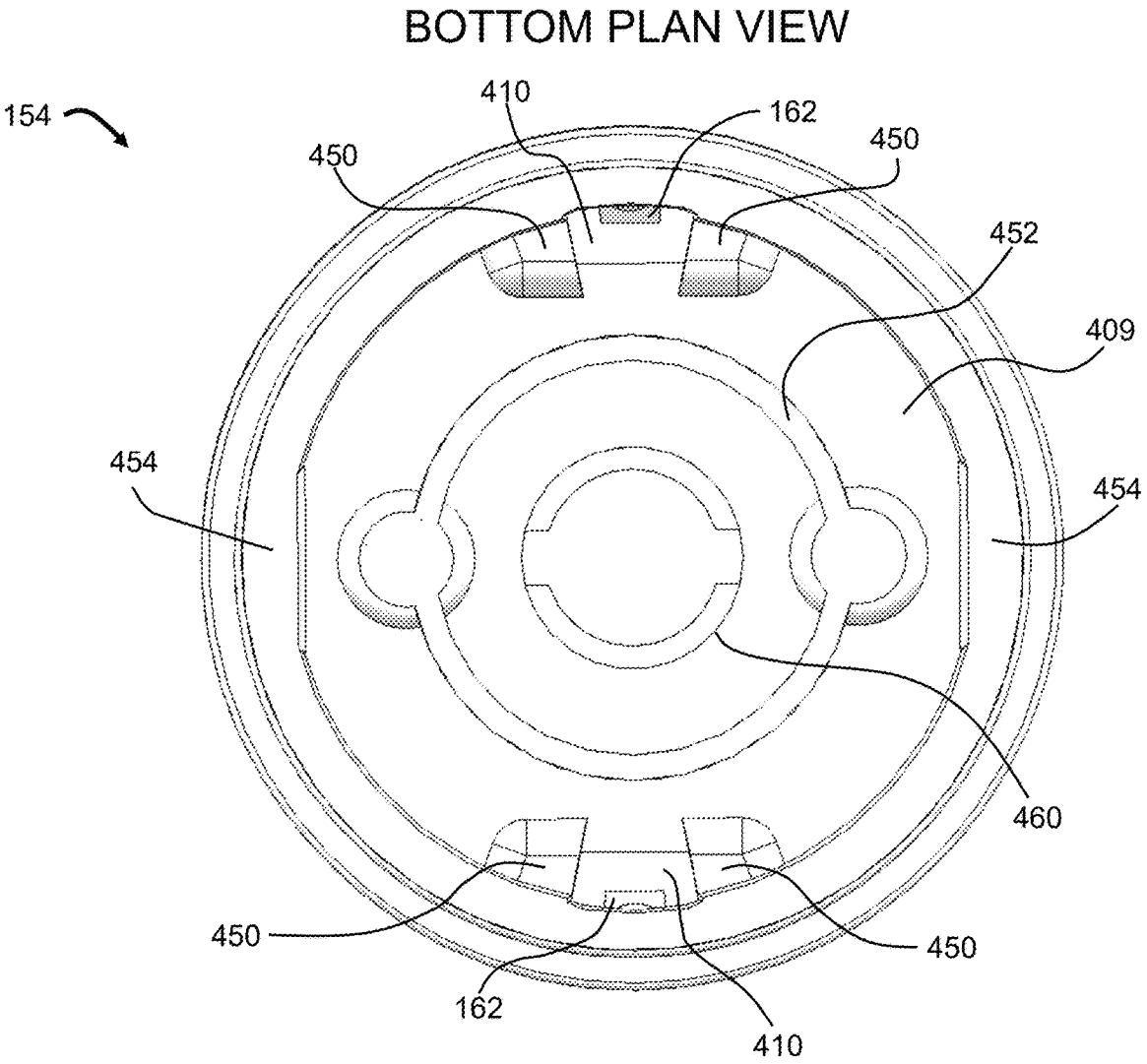
FIG. 21 is a schematic diagram that illustrates a bottom plan view of the second construction set element of the construction set assembly of FIG. 9, according to an embodiment.
Figure 22:
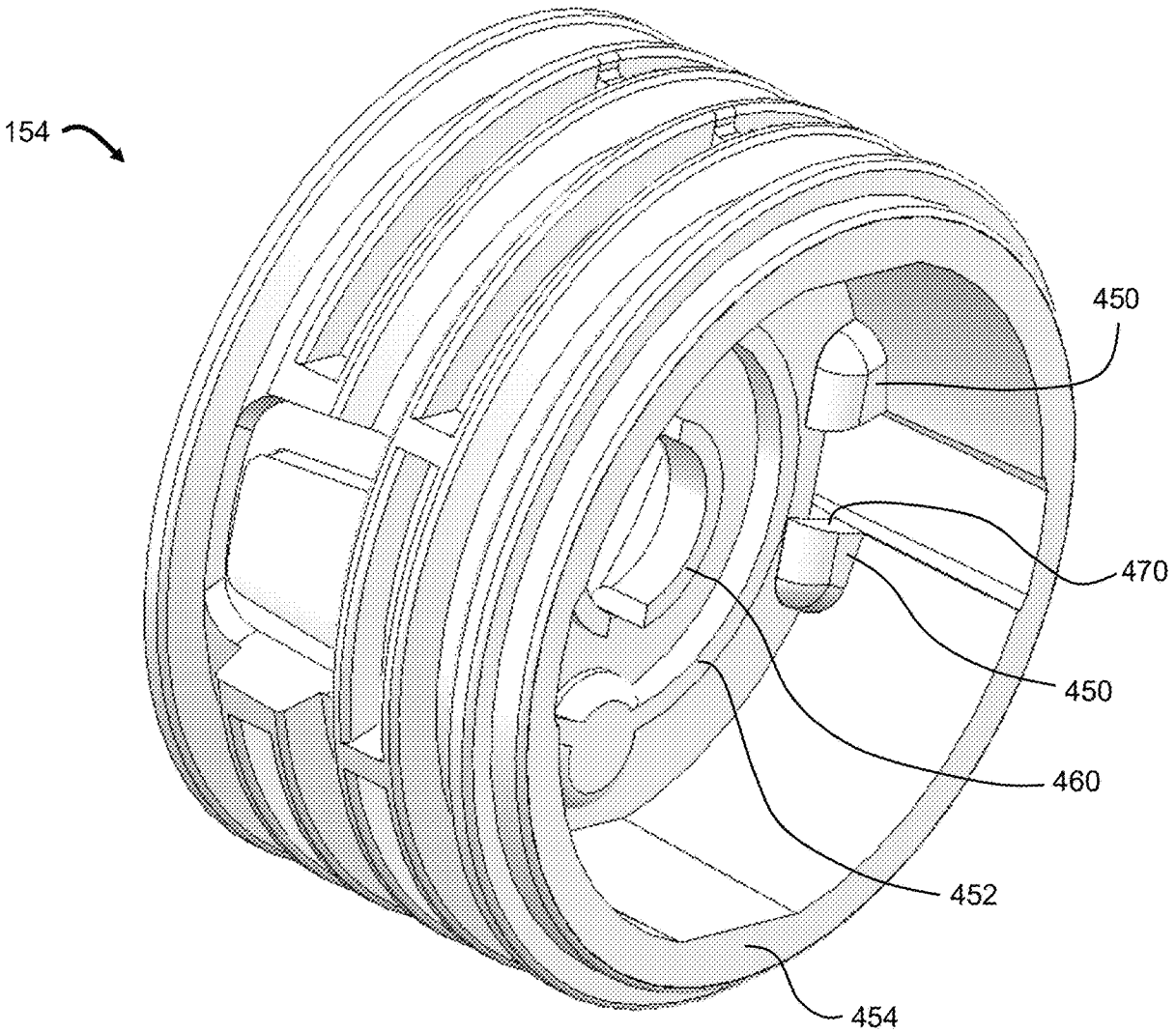
FIG. 22 is a schematic diagram that illustrates a perspective view of the second construction set element of the construction set assembly of FIG. 9, according to an embodiment.

FIGS. 20-22 illustrates additional provisions for added strength and rigidity. For example, the second construction element 154 may include buttress portions 450 connecting the cylindrical wall 418 and the interior base wall 409. Each of the buttress portions 450 may be disposed in a corner of the cylindrical wall 418 and the interior base wall 409 on a side of the interior base wall 409 opposite to the opening 160, and may have a face 470 aligned with an edge of the recessed surface 429. The recessed surface 429 may extend from the snap fitting 162 through to the end of the cylindrical body 438 as shown in FIGS. 16 and 17, for example. Buttress portions 450 may have a rounded pill shape body extending from the face 470 in a direction away from the center of the opening 410, may be disposed opposite to each other across the opening 410, and may cover end portions of the opening 410 through the interior base wall 409. The interior base wall 409 may also include an annular reinforcing rib 452 as shown in FIGS. 21 and 22. Cylindrical body 438 may include increased wall thicknesses 454 on a side of the interior base wall 409 opposite to the opening 160 at locations longitudinally aligned with locations 180, 182, as shown in FIGS. 21 and 22. Although the embodiment of FIGS. 20-22 depicts four buttress portions 450 and one annular reinforcing rib 452, the number of buttress portions and ribs may vary depending on the desired additional structural support. In addition, the size, shape, and placement of the buttress portions and ribs may vary depending on the desired additional structural support.

In embodiments, the second construction element 154 may also include provisions for connecting to other construction set elements. For example, as shown in FIGS. 9 and 20-22, the second construction element 154 may include a hub 460 configured to receiving an axle around which the construction set assembly 150 may rotate.

As described above, embodiments may lead to surprising benefits in connecting construction set elements made of different materials. In particular, embodiments may provide a first construction set element (e.g., first construction element 102 or first construction element 152) that has a relatively fixed structure with minimal, or no, moving parts or portions and that is made of a strong, durable material, such as metal. Examples of suitable metals include zinc, aluminum, magnesium, copper, brass, and tin. To connect to the first construction set element, embodiments may provide a second construction set element that has a flexible structure or flexible components that may start in an initial configuration, then temporarily deflect to receive the fixed shape and size of the first construction set element, and then return to the initial configuration to retain the first construction set element in an assembly of the first and second construction set element. The second construction set element may be made of durable but flexible material such as acrylonitrile butadiene styrene ("ABS"), polyvinyl chloride ("PVC"), polypropylene ("PP"), polyethylene-vinyl acetate ("PE"), and ethylene-vinyl acetate ("EVA"). By provisioning the moving parts or portions on a plastic construction set element, embodiments may avoid metal moving parts or portions that tend to be subject to fatigue and eventual failure, especially over many cycles of movement in attaching and detaching other elements.

The various embodiments can be constructed using a variety of different materials. Exemplary materials that could be used for making a construction set element and/or a moving member for a construction set element, but are not limited to, various kinds of plastics, metals, or other materials. In some embodiments, one or more parts of a construction set element may be constructed from ABS. In other embodiments, one or more parts of a construction set element may be constructed from blends of ABS with other materials, such as polycarbonate/acrylonitrile butadiene styrene ("PC/ABS"). In embodiments, a single construction set element may be made of different materials at different regions and/or parts of the construction set element, as appropriate for the region or part. For example, referring to FIG. 1, a relatively hard and durable material could be used for the protruding pegs 106, upper wall 302, and/or walls 304, which may allow for better connections to other construction set elements (e.g., blocks), while a more flexible material could be used for the snap fittings 112, which may allow for more movement and may resist breaking, in temporarily deflecting to receive another construction element and then returning to an original configuration.

Although the disclosed embodiments are illustrated and described herein as embodied in one or more specific examples, it is nevertheless not intended to be limited to the details shown, since various modifications and structural changes may be made therein without departing from the scope of the present embodiments and within the scope and range of equivalents of the claims.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present embodiments to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment. Finally, various features from one of the embodiments may be incorporated into another of the embodiments.

The foregoing disclosure of the embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A construction set assembly comprising:

a metal construction element having a distal edge and a proximal recess adjacent to the distal edge; and a plastic construction element having a wall and defining a nest opening configured to receive the metal construction element, wherein the wall has an opening defining a cantilever member, wherein the cantilever member has a first end joined integral with the plastic construction element and a second end that is opposite to the first end and is unsupported and deflectable relative to an initial position of the cantilever member, wherein the second end has a hook protrusion protruding toward an interior of the nest opening, and wherein to connect the metal construction element to the plastic construction element, at least a portion of the metal construction element is inserted into the nest opening such that the distal edge of the metal construction element contacts the hook protrusion, deflects the second end of the cantilever member away from the interior of the nest opening, and moves past the hook protrusion to allow the second end of the cantilever member to move back toward the interior of the nest opening to return to the initial position with the hook protrusion disposed in the proximal recess.

2. The construction set assembly of claim 1, wherein when the metal construction element is disposed in the nest opening, the hook protrusion contacts the distal edge to secure the metal construction element to the plastic construction element.

3. The construction set assembly of claim 1, wherein the plastic construction element comprises:

an upper wall having an upper surface and a lower surface opposite to the upper surface, wherein a plurality of pegs protrudes from the upper surface, and wherein the pegs have a uniform size and shape and are positioned in a matrix;

a bottom side opposite to the upper wall and defining the nest opening and a plurality of openings for receiving pegs of the size, shape, and positioning associated with the pegs; and wherein the wall extends from the upper wall to the bottom side.

4. The construction set assembly of claim 3, wherein the plastic construction element has sidewalls extending between the upper wall and the bottom side, and wherein the nest opening is configured to receive the metal construction element such that the metal construction element nests flush with, or within, planes defined by outer surfaces of the upper wall, the bottom side, and the sidewalls.

5. The construction set assembly of claim 4, wherein the wall is interior to the plastic construction element and is perpendicular to, and connects, two of the sidewalls.

6. The construction set assembly of claim 5, wherein the wall has a wall section having a free end adjacent to the opening and wherein the plastic construction element further comprises a reinforcing rib attached to the upper wall and the free end of the wall section.

7. The construction set assembly of claim 4, wherein the sidewalls comprise a first lateral sidewall, a second lateral sidewall opposite to the first lateral sidewall, a first longitudinal sidewall, and a second longitudinal sidewall opposite to the first longitudinal sidewall, wherein, when viewed from a side facing the first longitudinal sidewall, the first longitudinal sidewall defines a first rectangular notch extending from the bottom side to a bottom edge of the first rectangular notch, wherein, when viewed from a side facing the second longitudinal sidewall, the second longitudinal sidewall defines a second rectangular notch extending from the bottom side to a bottom edge of the second rectangular notch, wherein the metal construction element comprises a plate portion having a first longitudinal rail with a first upper surface and a first longitudinal ledge, and a second longitudinal rail with a second upper surface and a second longitudinal ledge, wherein the nest opening is configured to receive the metal construction element such that the first longitudinal ledge is linearly aligned with the bottom edge of the first rectangular notch, and the second longitudinal ledge is linearly aligned with the bottom edge of the second rectangular notch, and wherein the first upper surface of the first longitudinal rail and the second upper surface of the second longitudinal rail are flush with, or within, the bottom side.

8. The construction set assembly of claim 7, wherein the plastic construction element further comprises a brace member on the lower surface of the upper wall extending from the first longitudinal wall to the second longitudinal wall within a longitudinal length of the first and second rectangular notches.

9. The construction set assembly of claim 8, wherein the metal construction element further comprises a base portion having a width narrower than a width of the plate portion from the first longitudinal rail to the second longitudinal rail, and wherein the width of the base portion is configured to fit between the first longitudinal wall and the second longitudinal wall such that the base portion rests on the brace member when the metal construction element is disposed in the nest opening of the plastic construction element, with the first longitudinal ledge linearly aligned with, and spaced apart from, the bottom edge of the first rectangular notch, and the second longitudinal ledge is linearly aligned with, and spaced apart from, the bottom edge of the second rectangular notch.

10. The construction set assembly of claim 8, wherein the plastic construction element defines an upper wall opening through the upper wall adjacent to the first end of the cantilever member, and wherein the brace member is disposed adjacent to the upper wall opening.

11. The construction set assembly of claim 8, wherein the upper wall of the plastic construction element defines an upper wall opening, wherein the metal construction element defines an opening, and wherein the upper wall opening is aligned with the opening of the metal construction element to define a passageway, when the metal construction element is disposed in the nest opening and connected to the plastic construction element.

12. The construction set assembly of claim 1, wherein the metal construction element defines an opening, and wherein the construction set assembly further comprises an attachment means attached to the opening of the metal construction element when the metal construction element is disposed in the nest opening and connected to the plastic construction element.

13. The construction set assembly of claim 1, wherein, in the initial position, an inner edge of the second end of the cantilever member that is closest to the nest opening is aligned with an inner edge of the wall that is closest to the nest opening, and the hook protrusion protrudes into the nest opening, and wherein when the distal edge deflects the second end of the cantilever member, the inner edge of the second end of the cantilever member moves farther from the nest opening than the inner edge of the wall.

14. The construction set assembly of claim 1, wherein the wall has a cylindrical curvature, and wherein perimeter faces of the cantilever member have a curvature conforming to the cylindrical curvature.

15. The construction set assembly of claim 1, wherein the plastic construction element comprises:

a cylindrical body defining a longitudinal axis, an interior base wall disposed inside the cylindrical body and perpendicular to the longitudinal axis of the cylindrical body, wherein the nest opening is on a first side of the interior base wall and defined by the interior base wall and the cylindrical body, and wherein a bottom opening is on a second side of the interior base wall opposite to the first side of the interior base wall and defined by the interior base wall and the cylindrical body, wherein the wall that has the opening defining the cantilever member is a wall of the cylindrical body on the first side of the interior base wall, wherein the interior base wall defines an opening adjacent to the wall, and wherein the first end of the cantilever member is disposed adjacent to the opening of the interior base wall.

16. The construction set assembly of claim 15, wherein the metal construction element comprises a cylindrical disc, wherein the proximal recess is an annular groove around the cylindrical disc, and wherein the distal edge is an annular ring around the cylindrical disc.

17. The construction set assembly of claim 15, wherein the plastic construction element further comprises a buttress portion disposed at a corner between the cylindrical body and the second side of the interior base wall, adjacent to the opening of the interior base wall.

18. The construction set assembly of claim 1, wherein the metal construction element is made of a zinc alloy and the plastic construction element is made of acrylonitrile butadiene styrene.

19. A construction set element comprising:

an upper wall having an upper surface and a lower surface opposite to the upper surface, wherein a plurality of pegs protrudes from the upper surface, and wherein the pegs have a uniform size and shape and are positioned in a matrix;

a bottom side that is opposite to the upper wall and defines a nest opening and a plurality of openings for receiving pegs of the size, shape, and positioning associated with the pegs;

a wall that extends perpendicularly from the upper wall to the bottom side wherein the wall has an opening defining a cantilever member, wherein the cantilever member has a first end joined integral with the construction set element and a second end that is opposite to the first end and is unsupported and deflectable relative to an initial position of the cantilever member, and wherein the second end has a hook protrusion protruding toward an interior of the nest opening; and a plurality of sidewalls extending between the upper wall and the bottom side, wherein the nest opening is configured to receive into the nest opening a second construction set element having a distal edge and a proximal recess adjacent to the distal edge, such that the second construction set element nests flush with, or within, planes defined by outer surfaces of the upper wall, the bottom side, and the plurality of sidewalls, with the hook protrusion disposed in the proximal recess.

20. A construction set element comprising:

a cylindrical body defining a longitudinal axis; and an interior base wall disposed inside the cylindrical body and perpendicular to the longitudinal axis of the cylindrical body, wherein a nest opening is defined by the interior base wall and the cylindrical body on a first side of the interior base wall, wherein a bottom opening is defined by the interior base wall and the cylindrical body on a second side of the interior base wall opposite to the first side of the interior base wall, wherein a wall of the cylindrical body on a first side of the interior base wall has an opening defining a cantilever member, wherein the cantilever member has a first end joined integral with the construction set element and a second end that is opposite to the first end and is unsupported and deflectable relative to an initial position of the cantilever member, wherein the second end has a hook protrusion protruding toward an interior of the nest opening, wherein the interior base wall defines an opening adjacent to the wall, wherein the first end of the cantilever member is disposed adjacent to the opening of the interior base wall, and wherein the nest opening is configured to receive into the nest opening a second construction element having a distal edge and a proximal recess adjacent to the distal edge, with the hook protrusion disposed in the proximal recess.

* * * * *